US008903536B2

(12) United States Patent
Yamada

(10) Patent No.: US 8,903,536 B2
(45) Date of Patent: Dec. 2, 2014

(54) APPARATUS AND NON-TRANSITORY COMPUTER-READABLE MEDIUM

(71) Applicant: Kenji Yamada, Nagoya (JP)

(72) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/244,005

(22) Filed: Apr. 3, 2014

(65) Prior Publication Data

US 2014/0324209 A1 Oct. 30, 2014

(30) Foreign Application Priority Data

Apr. 24, 2013 (JP) ..... 2013-091700

(51) Int. Cl.
*D05C 5/02* (2006.01)
*D05C 5/04* (2006.01)

(52) U.S. Cl.
CPC ..... *D05C 5/04* (2013.01)
USPC ..... 700/138; 112/102.5; 112/470.01

(58) Field of Classification Search
USPC ..... 700/136–138; 112/102.5, 447, 470.01, 112/470.04, 470.06, 475.18, 475.19
See application file for complete search history.

(56) References Cited

U.S. PATENT DOCUMENTS

| | | | | |
|---|---|---|---|---|
| 6,629,015 | B2 * | 9/2003 | Yamada | 700/138 |
| 7,693,598 | B2 * | 4/2010 | Yamada | 700/138 |
| 7,996,103 | B2 * | 8/2011 | Yamada | 700/138 |
| 8,065,030 | B2 * | 11/2011 | Yamada | 700/138 |
| 8,738,172 | B2 * | 5/2014 | Muto et al. | 700/138 |
| 2002/0038162 | A1 | 3/2002 | Yamada | |
| 2010/0145494 | A1 | 6/2010 | Yamada | |
| 2011/0160894 | A1 * | 6/2011 | Yamada | 700/138 |

FOREIGN PATENT DOCUMENTS

| | | |
|---|---|---|
| JP | A-2001-259268 | 9/2001 |
| JP | A-2010-131272 | 6/2010 |

* cited by examiner

*Primary Examiner* — Nathan Durham
(74) *Attorney, Agent, or Firm* — Oliff PLC

(57) ABSTRACT

An apparatus includes a processor and a memory. The memory is configured to store computer-readable instructions. The computer-readable instructions cause the processor to perform a process that includes arranging, based on image data of an image that is an aggregate of a plurality of pixels, a plurality of line segments in an area corresponding to the image. The plurality of line segments each have two endpoints, which are a starting point and an ending point. The computer-readable instructions further cause the processor to perform a process that includes sequentially connecting the arranged plurality of line segments. The computer-readable instructions further cause the processor to perform a process that includes creating, as embroidery data, data for stitches that correspond to the connected plurality of line segments.

14 Claims, 15 Drawing Sheets

FIG. 6

| PRIORITY ORDER | ANGLE DIFFERENCE RANGE | AREA (DISTANCE RANGE, ANGLE RANGE) |
|---|---|---|
| 1 | 1 | A |
| 2 | 1 | B |
| 3 | 1 | C |
| 4 | 2 | B |
| 5 | 2 | A |
| 6 | 2 | C |
| 7 | 3 | A |
| 8 | 3 | C |
| 9 | 3 | B |
| 10 | 1 | D |
| 11 | 2 | D |
| 12 | 3 | D |
| 13 | – | – |

APPARATUS AND NON-TRANSITORY COMPUTER-READABLE MEDIUM

CROSS-REFERENCE TO RELATED APPLICATION

This application claims priority to Japanese Patent Application No. 2013-091700 filed Apr. 24, 2013, the content of which is hereby incorporated herein by reference.

BACKGROUND

The present disclosure relates to an apparatus that is capable of creating embroidery data to perform embroidery sewing using a sewing machine, and a non-transitory computer-readable medium.

An apparatus is known that creates embroidery data to perform embroidery sewing of a design based on data of an image, such as a photograph or the like, using a sewing machine. Generally, this type of apparatus may create the embroidery data using the following procedure. First, based on the image data, an angle characteristic of each of a plurality of pixels that form the image may be calculated. Line segments may be arranged according to the angle characteristics. A thread color corresponding to each of the line segments may be determined according to a color in the image. The line segments with the same thread color may be connected. Data of the line segments may be converted to data indicating stitches, and the embroidery data may thereby be created.

In order to express an embroidery pattern using natural stitches, it is desirable that, as much as possible, a line of the stitches does not bend or fold back. For example, in a case where a distance from an ending point of a particular line segment to an endpoint of another line segment is within a predetermined range and an angle difference between the particular line segment and the other line segment is within a predetermined range, a known embroidery data creation apparatus connects the endpoint of the other line segment to the ending point of the particular line segment. The embroidery data creation apparatus repeats this processing and thereby connects a plurality of line segments.

SUMMARY

The above-described known embroidery data creation apparatus can express an embroidery pattern using natural stitches in a case where, among all the line segments, line segments having similar angles are adjacent to each other. However, the line segments having similar angles are not necessarily adjacent to each other. Therefore, the above-described effect may be a limited effect.

Embodiments of the broad principles derived herein provide an apparatus that is capable of creating embroidery data to form stitches that can naturally express an embroidery pattern, and a non-transitory computer-readable medium.

Embodiments provide an apparatus that includes a processor and a memory. The memory is configured to store computer-readable instructions. The computer-readable instructions cause the processor to perform a process that includes arranging, based on image data of an image that is an aggregate of a plurality of pixels, a plurality of line segments in an area corresponding to the image. The plurality of line segments each have two endpoints, which are a starting point and an ending point. The computer-readable instructions further cause the processor to perform a process that includes sequentially connecting the arranged plurality of line segments. The computer-readable instructions further cause the processor to perform a process that includes creating, as embroidery data, data for stitches that correspond to the connected plurality of line segments. The sequentially connecting the plurality of line segments includes, until all the plurality of line segments are connected, repeating processes that include identifying, as a first line segment, a line segment having an ending point that is not connected to another line segment, from among the plurality of line segments, calculating a distance between the ending point of the first line segment and a starting point of at least one second line segment, both of two endpoints of the at least one second line segment being not connected to another line segment, and the starting point of the at least one second line segment being an endpoint that is closer to the ending point of the first line segment, among the two endpoints of the at least one second line segment, calculating an angle difference between a first angle and a second angle, the first angle being an angle of the first line segment with respect to a reference line, and the second angle being an angle of the at least one second line segment with respect to the reference line, identifying a third angle, the third angle being an angle formed by the first line segment and a third line segment, the third line segment being a line segment connecting the ending point of the first line segment and the starting point of the at least one second line segment, and connecting to the ending point of the first line segment, in accordance with a priority order, a starting point of the second line segment for which a priority corresponding to a combination of a distance range to which the distance belongs, an angle difference range to which the angle difference belongs, and an angle range to which the third angle belongs is highest among the at least one second line segments. The priority order is set in advance for a plurality of combinations in which one of a plurality of distance ranges, one of a plurality of angle difference ranges, and one of a plurality of angle ranges are combined.

Embodiments also provide a non-transitory computer-readable medium storing computer-readable instructions that, when executed by a processor of an apparatus, instruct the processor to perform processes that include arranging, based on image data of an image that is an aggregate of a plurality of pixels, a plurality of line segments in an area corresponding to the image, the plurality of line segments each having two endpoints, which are a starting point and an ending point, sequentially connecting the arranged plurality of line segments, and creating, as embroidery data, data for stitches that correspond to the connected plurality of line segments. The sequentially connecting the plurality of line segments includes, until all the plurality of line segments are connected, repeating processes that include identifying, as a first line segment, a line segment having an ending point that is not connected to another line segment, from among the plurality of line segments, calculating a distance between the ending point of the first line segment and a starting point of at least one second line segment, both of two endpoints of the at least one second line segment being not connected to another line segment, and the starting point of the at least one second line segment being an endpoint that is closer to the ending point of the first line segment, among the two endpoints of the at least one second line segment, calculating an angle difference between a first angle and a second angle, the first angle being an angle of the first line segment with respect to a reference line, and the second angle being an angle of the at least one second line segment with respect to the reference line, identifying a third angle, the third angle being an angle formed by the first line segment and a third line segment, the third line segment being a line segment connecting the ending point of the first line segment and the starting point of the at least one second line segment, and connecting to the ending point of the first line segment, in accordance with a priority order, a starting point of the second line segment for which a priority corresponding to a combination of a distance range to which the distance belongs, an angle difference range to which the angle difference belongs, and an angle range to which the third angle belongs is highest among the at least one second line segments. The priority order is set in advance for a plurality of combinations in which one of a plurality of distance ranges, one of a plurality of angle difference ranges, and one of a plurality of angle ranges are combined.

BRIEF DESCRIPTION OF THE DRAWINGS

Embodiments will be described below in detail with reference to the accompanying drawings in which:

FIG. 6 is an explanatory diagram of an order of priority that is set based on angle difference ranges, the distance ranges, and the angle ranges;

DETAILED DESCRIPTION

Hereinafter, an embodiment will be explained with reference to FIGS. 1 to 12. First, the configuration of an embroidery data creation apparatus 1 will be explained with reference to FIG. 1. The embroidery data creation apparatus 1 is an apparatus that can create embroidery data to form stitches of an embroidery pattern using a sewing machine 3 (refer to FIG. 2), which will be described below. The embroidery data creation apparatus 1 of the present embodiment can create embroidery data to perform embroidery sewing of a design based on an image such as a photograph or the like.

Figure 1:
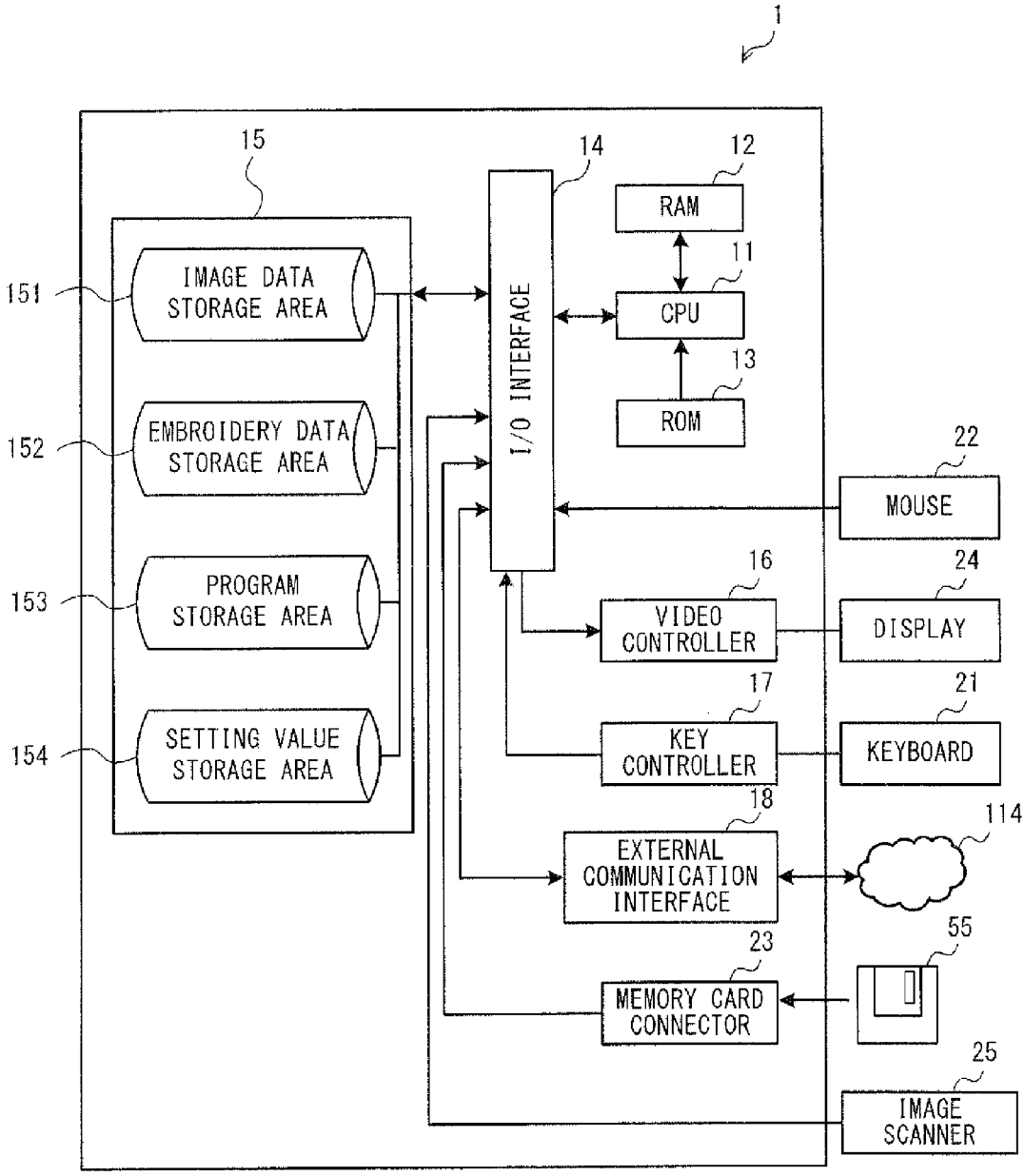
FIG. 1 is a block diagram showing an electrical configuration of an embroidery data creation apparatus.

The embroidery data creation apparatus 1 may be an apparatus dedicated to creating embroidery data, or may be a general-purpose apparatus such as a personal computer or the like. In the present embodiment, the general-purpose embroidery data creation apparatus 1 is exemplified. As shown in FIG. 1, the embroidery data creation apparatus 1 includes a CPU 11, which is a controller that controls the embroidery data creation apparatus 1. A RAM 12, a ROM 13, and an input/output (I/O) interface 14 are connected to the CPU 11. The RAM 12 may temporarily store various types of data, such as calculation results etc. that are obtained by arithmetic processing by the CPU 11. The ROM 13 may store a basic input output system (BIOS) and the like.

The I/O interface 14 is configured to perform relay of data transmission and reception. A hard disk device (HDD) 15, a mouse 22, which is an input device, a video controller 16, a key controller 17, an external communication interface 18, a memory card connector 23 and an image scanner 25 are connected to the I/O interface 14.

A display 24, which is a display device, is connected to the video controller 16. A keyboard 21, which is an input device, is connected to the key controller 17. The external communication interface 18 is an interface that allows connection to a network 114. The embroidery data creation apparatus 1 may connect to an external device via the network 114. A memory card 55 may be connected to the memory card connector 23. The embroidery data creation apparatus 1 may read data from the memory card 55 and write data to the memory card 55, via the memory card connector 23.

Storage areas of the HDD 15 will be explained. As shown in FIG. 1, the HDD 15 has a plurality of storage areas, including an image data storage area 151, an embroidery data storage area 152, a program storage area 153, and a setting value storage area 154. Image data of various images, such as an image that serves as a basis for embroidery data creation, may be stored in the image data storage area 151. The embroidery data that is created by embroidery data creation processing of the present embodiment may be stored in the embroidery data storage area 152. Programs for various types of processing executed by the embroidery data creation apparatus 1, such as an embroidery data creation program (which will be described below) and the like, may be stored in the program storage area 153. Data of setting values that are used in various types of processing may be stored in the setting value storage area 154.

The embroidery data creation program may be acquired from the outside via the network 114 and may be stored in the program storage area 153. In a case where the embroidery data creation apparatus 1 is provided with a DVD drive, the embroidery data creation program stored in a medium, such as a DVD, may be read and stored in the program storage area 153.

Figure 2:
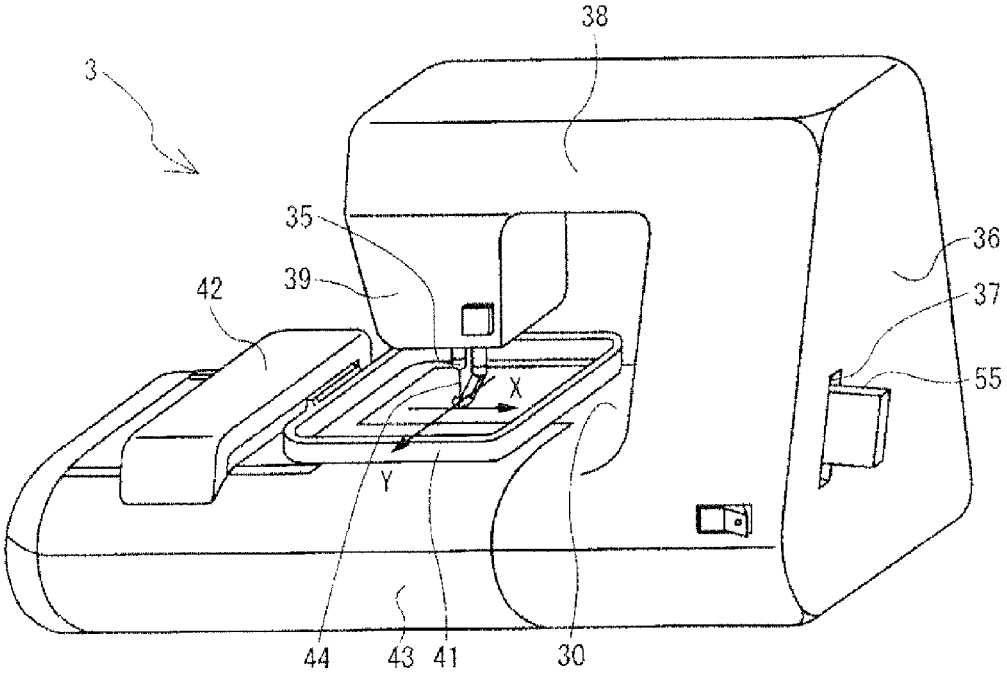
FIG. 2 is an external view of a sewing machine.

The sewing machine 3, which can sew an embroidery pattern based on the embroidery data, will be briefly explained with reference to FIG. 2, As shown in FIG. 2, the sewing machine 3 includes a bed 30, a pillar 36, an arm 38, and a head 39. The bed 30 is a base portion of the sewing machine 3 and is longer in the left-right direction. The pillar 36 extends upward from a right end portion of the bed 30. The arm 38 extends leftward from the upper end of the pillar 36 such that the arm 38 faces the bed 30. The head 39 is a portion that connects to the left end of the arm 38.

In a case where embroidery sewing is performed, a user of the sewing machine 3 may mount an embroidery frame 41 that holds a work cloth on a carriage 42 that is disposed on the bed 30. The embroidery frame 41 may be moved to a needle drop point indicated by an X-Y coordinate system that is unique to the sewing machine 3, by a Y direction movement mechanism (not shown in the drawings) and an X direction movement mechanism (not shown in the drawings). The Y direction movement mechanism is housed in the carriage 42. The X direction movement mechanism is housed in a main body case 43. A needle bar 35, to which a sewing needle 44 is attached, and a shuttle mechanism (not shown in the drawings) may be driven in synchronization with the embroidery frame 41 being moved, and thus an embroidery pattern may be formed on the work cloth. The Y direction movement mechanism, the X direction movement mechanism, the needle bar 35, and the like may be controlled by a CPU (not shown in the drawings) incorporated in the sewing machine 3, based on the embroidery data. The embroidery data of the present embodiment is data that represents coordinates of needle drop points that are used to form stitches of the embroidery pattern, a sewing order, and a color of an embroidery thread to be used.

A memory card slot 37 is provided in a side surface of the pillar 36 of the sewing machine 3. The memory card 55 may be inserted into and removed from the memory card slot 37. For example, the embroidery data created by the embroidery data creation apparatus 1 may be stored in the memory card 55 via the memory card connector 23. After that, the memory card 55 may be inserted into the memory card slot 37 of the sewing machine 3, and the stored embroidery data may be read out and stored in the sewing machine 3. Based on the embroidery data read out from the memory card 55, the CPU of the sewing machine 3 may control sewing operations of the embroidery pattern that are performed by the above-described elements. In this manner, the sewing machine 3 may sew the embroidery pattern based on the embroidery data created by the embroidery data creation apparatus 1.

The embroidery data creation processing that is performed by the embroidery data creation apparatus 1 of the present embodiment will be explained with reference to FIGS. 3 to 12. The embroidery data creation processing may be started when the user inputs an instruction to start the processing. The CPU 11 may read out the embroidery data creation program stored in the program storage area 153 of the HDD 15, and may perform the following processing by executing instructions included in the program.

Figure 3:
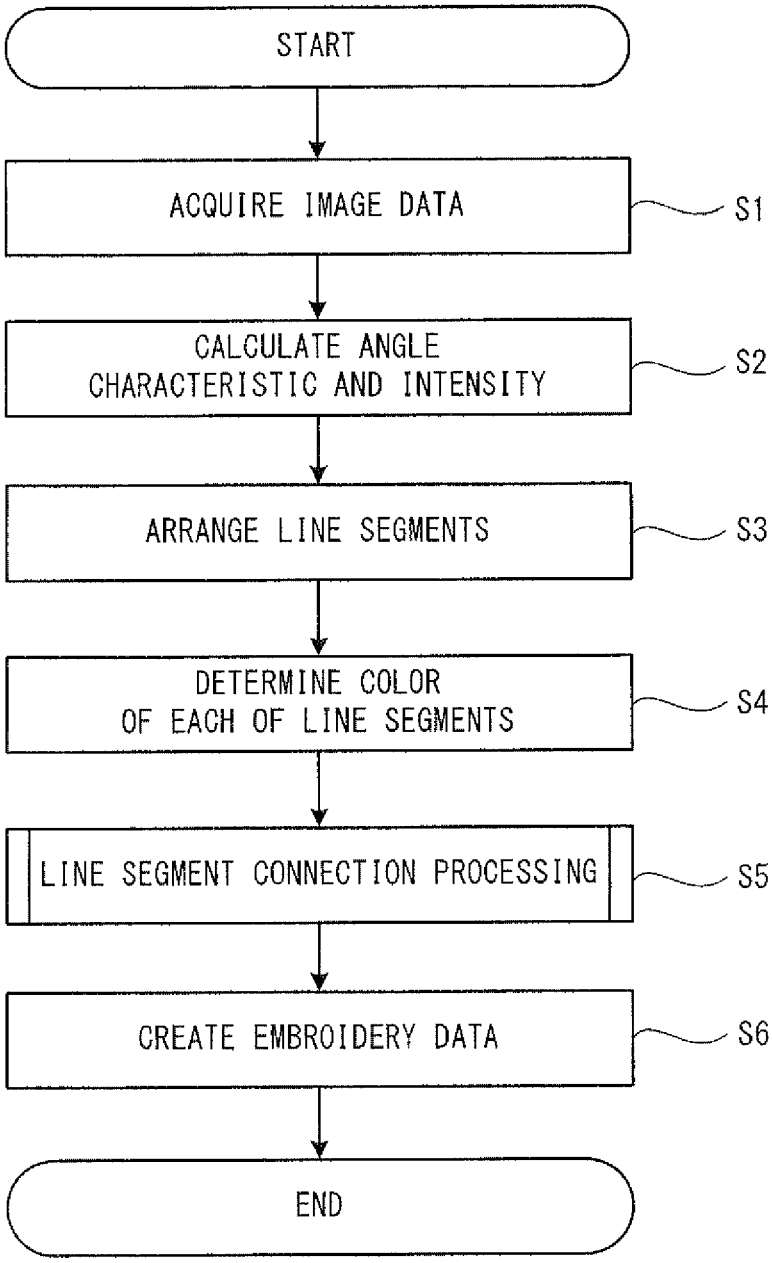
FIG. 3 is a flowchart of embroidery data creation processing.

As shown in FIG. 3, first, the CPU 11 acquires image data of an image (hereinafter referred to as an original image) that serves as a basis for embroidery data creation (step S1). A method of acquiring the image data is not particularly limited. For example, an image, such as a photograph or a design, may be read by the image scanner 25 and the acquired image data may be used. Alternatively, the CPU 11 may acquire the image data stored in advance in the image data storage area 151 of the HDD 15. The CPU 11 may acquire the image data from the outside via the network 114. The CPU 11 may acquire the image data stored in a medium, such as the memory card 55. The image data may be, for example, data that indicates the color of each pixel using RGB values. The image data may be data that indicates the color of each pixel using another form (for example, hue, brightness, or saturation) instead of the RGB values.

Based on the acquired image data, the CPU 11 calculates an angle characteristic and an intensity of the angle characteristic for each of a plurality of pixels that form the original image (step S2). The angle characteristic is information that indicates a direction in which color continuity in the image is high. In other words, when the color of a certain pixel is compared with colors of surrounding pixels, the angle characteristic is information indicating a direction (angle) in which the color of the certain pixel is most continuous. The intensity of the angle characteristic is information indicating the magnitude of color change.

The CPU 11 may use any method to calculate the angle characteristics and the intensity of the angle characteristic. For example, Japanese Laid-Open Patent Publication No. 2001-259268 (US Patent Application Publication No. 2002/0038162) discloses a method of calculating an angle characteristic and an intensity of the angle characteristic, the relevant portions of which are incorporated by reference. A brief explanation will be made here. First, the CPU 11 specifies, as a target pixel, one of the plurality of pixels that form the original image, and specifies, as a target area, the target pixel and a predetermined number (eight, for example) of pixels surrounding the target pixel. Based on an attribute value (a luminance value, for example) relating to the color of each of the pixels in the target area, the CPU 11 identifies the direction in which the color continuity in the target area is high, and sets the identified direction as the angle characteristic of the target pixel. Further, the CPU 11 calculates a value indicating the magnitude of color change in the target area, and sets the calculated value as the intensity of the angle characteristic of the target pixel. The CPU 11 may calculate the angle characteristic and the intensity of the angle characteristics using a Prewitt operator or a Sobel operator, instead of the method described above.

Based on the angle characteristics and the intensities of the angle characteristics that have been calculated, the CPU 11 performs processing to arrange a plurality of line segments in an area that corresponds to the original image (step S3). Each of the line segments corresponds to a stitch in the embroidery pattern, and has two endpoints that correspond to needle drop points. The line segments arranged at step S3 have a certain length corresponding to a value input via the keyboard 21 by the user or a value that is determined in advance and stored in the setting value storage area 154 of the HDD 15. The CPU 11 stores data to identify the arranged line segments (hereinafter referred to as line segment data) in the RAM 12. In the present embodiment, the line segment data is coordinate data of the X-Y coordinate system that indicates positions of the endpoints of all the line segments arranged in the area that corresponds to the original image.

The CPU 11 may use any method to arrange the line segments based on the angle characteristics and the intensities of the angle characteristics. For example, Japanese Laid-Open Patent Publication No. 2001-259268 (US Patent Application Publication No. 2002/0038162) discloses a method of arranging line segments based on angle characteristics and intensities of the angle characteristics, the relevant portions of which are incorporated by reference. A brief explanation will be made here. First, the CPU 11 preferentially arranges line segments whose centers correspond to respective pixels for which the intensities of the angle characteristics are equal to or larger than a predetermined threshold value. After that, the CPU 11 arranges line segments whose centers correspond to respective pixels for which the intensities of the angle characteristics are smaller than the predetermined threshold value. With respect to the pixels for which the intensities of the angle characteristics are smaller than the predetermined threshold value, the CPU 11 arranges a line segment only for a pixel that does not overlap with the already arranged line segment. Further, the CPU 11 re-calculates the angle characteristic of the pixel taking into account angle characteristics of pixels around the pixel, and then arranges the line segment based on the re-calculated angle characteristic.

After arranging the line segments, the CPU 11 performs processing that determines a color of each of the line segments (step S4). The CPU 11 may use any method to determine the color of each of the line segments. For example, Japanese Laid-Open Patent Publication No. 2001-259268 (US Patent Application Publication No. 2002/0038162) discloses a method of determining a color of each of line segments, the relevant portions of which are incorporated by reference. A brief explanation will be made here. The CPU 11 sets a predetermined range centered on the target pixel in the original image, as a range (a reference area) in which colors of the original image are referred to. The CPU 11 determines the color of the line segment that corresponds to the target pixel such that an average value of colors in the reference area of the original image is equal to an average value of colors that have already been determined for line segments arranged in a corresponding area. The corresponding area is an area of the same size as the reference area centered on the target pixel. More specifically, the CPU 11 sequentially determines the colors of the line segments based on the colors of the original image and the colors of the line segments that have already been determined.

Based on the determined colors of the line segments, the CPU 11 determines a color of a thread (a thread color) that is used to sew a stitch that corresponds to each of the line segments. For example, the CPU 11 may determine, as a thread color corresponding to each of the line segments, a thread color that is closest to the determined color of each of the line segment, among N thread colors that are set as thread colors actually used for embroidery sewing. Specifically, the CPU 11 may obtain a spatial distance in the RGB space between the RGB values for each of the N thread colors and the RGB values for the color of the line segment, and may determine the thread color for which the spatial distance is the shortest as the thread color corresponding to the line segment. The CPU 11 adds data indicating the thread color of each of the line segments to the line segment data, and stores the updated data in the RAM 12.

After all the colors of the plurality of line segments are determined, the CPU 11 performs line segment connection processing that sequentially connects the plurality of line segments for each color (step S5). The line segment connection processing will be described below. After the CPU 11 creates, in the line segment connection processing, data indicating positions (coordinates) of endpoints of the connected line segments, a connecting order, and thread colors, the CPU 11 performs processing that creates embroidery data (step S6). Specifically, the CPU 11 converts the coordinates of the endpoints of all the line segments into coordinates of the coordinate system that is unique to the sewing machine 3, and thereby creates the data indicating the needle drop points, the sewing order, and the thread colors. In this manner, the CPU 11 creates the embroidery data. After creating the embroidery data, the CPU 11 ends the embroidery data creation processing shown in FIG. 3.

The line segment connection processing will be explained in detail with reference to FIGS. 4 to 12. First, conditions that are taken into consideration when a line segment to be connected to a particular line segment is determined from among a plurality of line segments will be explained with reference to FIGS. 4 and 5. In the present embodiment, the following three conditions are taken into consideration.

The first condition is the distance between an ending point of the particular line segment and a starting point of another line segment. The starting point is, among the two endpoints of a line segment, the endpoint corresponding to a needle drop point that is pierced first by a needle. The ending point is, among the two endpoints of the line segment, the endpoint corresponding to a needle drop point that is pierced second by the needle. The second condition is an angle difference that is a difference between an angle of the particular line segment and an angle of the other line segment. The third condition is the angle formed by the particular line segment and a line segment that connects the ending point of the particular line segment and the starting point of the other line segment. The CPU 11 determines a line segment from among the plurality of line segments in accordance with a priority corresponding to the three conditions. In the present embodiment, a priority order is set in advance far a plurality of combinations in which one of a plurality of distance ranges, one of a plurality of angle difference ranges, and one of a plurality of angle ranges are combined.

The plurality of distance ranges include a distance range that is equal to or smaller than a first distance d1, a distance range that is larger than the first distance d1 and equal to or smaller than a second distance d2, and a distance range that is larger than the second distance d2. The plurality of angle difference ranges include an angle difference range in which the absolute value of the angle difference is equal to or smaller than a first threshold value θ1, an angle difference range in which the absolute value of the angle difference is equal to or larger than a value (180 degrees−θ2) obtained by subtracting a second threshold value θ2 from 180 degrees, and an angle difference range in which the absolute value of the angle difference is larger than the first threshold value θ1 and smaller than the value obtained by subtracting the second threshold value θ2 from 180 degrees. The plurality of angle ranges include an angle range that is equal to or larger than a third threshold value θ3, an angle range that is smaller than the third threshold value θ3 and larger than a fourth threshold value θ4, and an angle range that is equal to or smaller than the fourth threshold value θ4. All of the first threshold value θ1, the second threshold value θ2, and the fourth threshold value θ4 are values that are larger than 0 degrees and smaller than 90 degrees. The third threshold value θ3 is a value that is equal to or larger than 90 degrees and smaller than 180 degrees.

Figure 4:
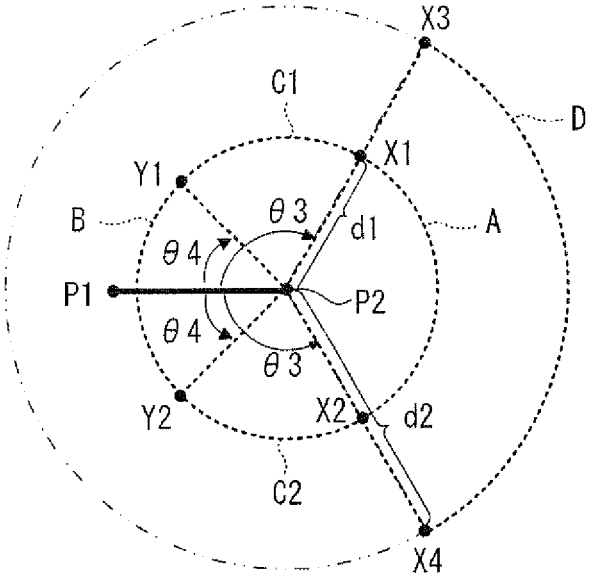
FIG. 4 is an explanatory diagram of areas A, B, and C (C1 and C2) that correspond to combinations of distance ranges and angle ranges.

In the present embodiment, the above-described distance ranges and angle ranges are expressed as areas based on an ending point P2 of a line segment P1P2 having a starting point P1 and the ending point P2, as shown in FIG. 4. Specifically, if a circle of a radius d1 with centered at the ending point P2 is drawn, an arbitrary point inside the circle is within the first distance d1 from the ending point P2. That is, an area (including the circumference) inside the circle of the radius d1 corresponds to the distance range that is equal to or smaller than the first distance d1. If a circle of a radius d2 (where d2 is larger than d1) with centered at the ending point P2 is drawn, an arbitrary point inside the circle is within the second distance d2 from the ending point P2. Therefore, an area of the circle of the radius d2 except a section overlapping with the circle of the radius d1 (this area includes the circumference of the circle of the radius d2, but does not include the circumference of the circle of the radius d1) corresponds to the distance range that is larger than the first distance d1 and equal to or smaller than the second distance d2. An area outside the circle of the radius d2 corresponds to the distance range that is larger than the second distance d2.

Further, a line segment whose angle with the line segment P1P2 is θ3 and which connects the ending point P2 and a point on the circumference of the circle of the radius d1 is identified. As shown in FIG. 4, there are two such line segments, i.e., a line segment P2X1 that forms the angle θ3 with the line segment P1P2 in the clockwise direction, and a line segment P2X2 that forms the angle θ3 with the line segment P1P2 in the counter-clockwise direction. Within the circle of the radius d1, an area which is located on the opposite side to the starting point P1 with respect to the ending point P2 and which is defined by the line segments P2X1 and P2X2 is referred to as an area A. When a starting point of a line segment other than the line segment P1P2 exists in the area A, an angle formed between the line segment P1P2 and a line segment connecting the ending point P2 and the starting point is equal to or larger than θ3. In other words, the area A corresponds to the angle range that is equal to or larger than the third threshold value θ3. FIG. 4 shows an example in which the third threshold value θ3 is set to 120 degrees.

Further, a line segment whose angle with the line segment P1P2 is θ4 (where θ4 is smaller than 03) and which connects the ending point P2 and a point on the circumference of the circle of the radius d1 is identified. As shown in FIG. 4, there are two such line segments, i.e., a line segment P2Y1 that forms the angle θ4 with the line segment P1P2 in the clockwise direction, and a line segment P2Y2 that forms the angle θ4 with the line segment P1P2 in the counter-clockwise direction. Within the circle of the radius d1, an area which is located on the same side as the starting point P1 with respect to the ending point P2 and which is defined by the line segments P2Y1 and P2Y2 is referred to as an area B. When a starting point of a line segment other than the line segment P1P2 exists in the area B, an angle formed between the line segment P1P2 and a line segment connecting the ending point P2 and the starting point is equal to or less than θ4. In other words, the area B corresponds to an angle range that is equal to or smaller than the fourth threshold value θ4. FIG. 4 shows an example in which the fourth threshold value θ4 is set to 45 degrees.

Further, in the clockwise direction and the counter-clockwise direction with respect to the line segment P1P2, within the circle of the radius d1, an area that is defined by the line segments P2X1 and P2Y1 and an area that is defined by the line segments P2X2 and P2Y2 are respectively referred to as an area C1 and an area C2. When a starting point of a line segment other than the line segment P1P2 exists in one of the area C1 and the area C2, an angle formed between the line segment P1P2 and a line segment connecting the ending point P2 and the starting point is smaller than θ3 and larger than θ4. In other words, the areas C1 and C2 correspond to the angle range that is smaller than the third threshold value θ3 and larger than the fourth threshold value θ4, and in this sense, the areas C1 and C2 are not differentiated from each other. Hereinafter, the area C1 and the area C2 are collectively referred to as an area C.

As described above, all the areas A, B, and C are areas within the circle of the radius d1. Therefore, the area A corresponds to the distance range that is equal to or smaller than the first distance d1 and the angle range that is equal to or larger than the third threshold value θ3. The area B corresponds to the distance range that is equal to or smaller than the first distance d1 and the angle range that is equal to or smaller than the fourth threshold value θ4. The area C corresponds to the distance range that is equal to or smaller than the first distance d1 and the angle range that is smaller than the third threshold value θ3 and larger than the fourth threshold value θ4.

Further, with respect to the distance range that is larger than the first distance d1 and equal to or smaller than the second distance d2, an area is similarly set for only a section that overlaps with a predetermined angle range. Specifically, a line segment whose angle with the line segment P1P2 is θ3 and which connects the ending point P2 and a point on the circumference of the circle of the radius d2 is identified. As shown in FIG. 4, a line segment P2X3 that forms the angle θ3 with the line segment P1P2 in the clockwise direction, and a line segment P2X4 that forms the angle θ3 with the line segment P1P2 in the counter-clockwise direction are identified. Of an area that is defined by the line segments P2X3 and P2X4 and that is located on the opposite side to the starting point P1 with respect to the ending point P2 within the circle of the radius d2, a section that is located on the outer peripheral side with respect to the area A is referred to as an area D. The area D corresponds to the distance range that is larger than the first distance d1 and equal to or smaller than the second distance d2 and the angle range that is equal to or larger than the third threshold value θ3.

In the present embodiment, an area other than the area D is not set in the distance range that is larger than the first distance d1 and equal to or smaller than the second distance d2. Further, no area is set in a distance range that is equal to or larger than the second distance d2. However, the setting of the areas is not limited to this example, and it is possible to set various areas, as will be described in detail below.

Figure 5:
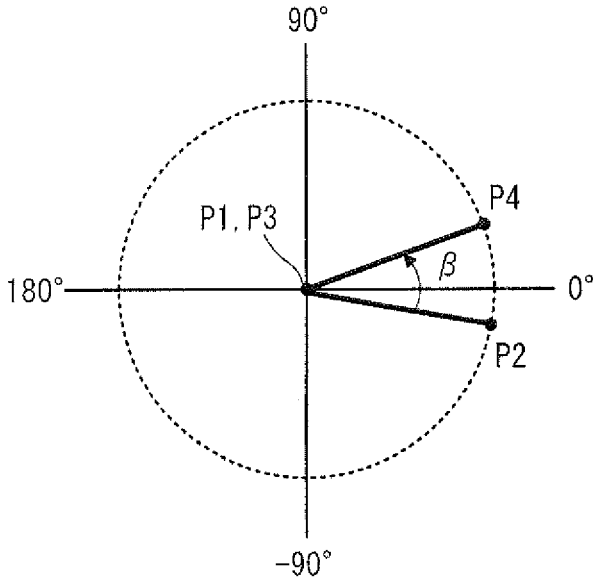
FIG. 5 is an explanatory diagram relating to a method of calculating an angle difference.

In the present embodiment, as shown in FIG. 5, the angle difference, which is a difference between the angle of the particular line segment (the line segment P1P2 in the example shown in FIG. 5) and the angle of the other line segment (the line segment P3P4 in the example shown in FIG. 5), is represented as an angle θ3 in the example shown in FIG. 5) that is formed by the two line segments when the starting points of the two line segments are arranged at the same position. Hereinafter, the angle difference range in which the absolute value of the angle difference is equal to or smaller than the first threshold value θ1 is referred to as an angle difference range 1. The angle difference range in which the absolute value of the angle difference is equal to or larger than the value (180 degrees−θ2) obtained by subtracting the second threshold value θ2 from 180 degrees is referred to as an angle difference range 2. The angle difference range other than the angle difference ranges 1 and 2, namely, the angle difference range in which the absolute value of the angle difference is larger than the first threshold value θ1 and smaller than the value obtained by subtracting the second threshold value θ2 from 180 degrees is referred to as an angle difference range 3.

In the present embodiment, the priority order is set for twelve types of combinations in which one of the four types of areas A to D that correspond to the combinations of the distance range and the angle range explained above, and one of the three types of angle difference ranges 1 to 3 are combined, and for a combination that does not correspond to the twelve types of combinations. Specifically, as shown in FIG. 6, the priority of each of the combinations descends in the following order: the angle difference range 1 and the area A, the angle difference range 1 and the area B, the angle difference range 1 and the area C, the angle difference range 2 and the area B, the angle difference range 2 and the area A, the angle difference range 2 and the area C, the angle difference range 3 and the area A, the angle difference range 3 and the area C, the angle difference range 3 and the area B, the angle difference range 1 and the area D, the angle difference range 2 and the area D, the angle difference range 3 and the area D, and the other combination. The value indicating the priority of each of the combinations indicates that the smaller the value is, the higher the priority is.

This means that the priority order for the distance range is set from the highest priority, in the following order: the distance range (the areas A to C) within the first distance d1, the distance range (the area D) that is larger than the first distance d1 and equal to or smaller than the second distance d2, and the distance range that is larger than the second distance d2. In other words, the closer the starting point of a line segment to the ending point of the particular line segment is, the higher the priority of that line segment is.

Further, at least in the distance range (the areas A to C) within the same first distance d1, the priority of the angle difference range 1 is the highest, and the priority descends in the order of the angle difference range 2 and the angle difference range 3. In other words, the highest priority is given to the line segment whose advancing direction (the direction from the starting point to the ending point) is relatively close to the advancing direction of the particular line segment. The second priority is given to the line segment whose advancing direction is relatively close to the direction opposite to the advancing direction of the particular line segment. Then, the lowest priority is given to the line segment whose advancing direction is relatively close to the direction perpendicular to the particular line segment.

Further, in the distance range (the areas A to C) within the same first distance d1, the priority order is set for the angle range in association with the angle difference range. Specifically, in the angle difference range 1, the priority descends in the following order: the angle range that is equal to or larger than the third threshold value θ3, the angle range that is equal to or smaller than the fourth threshold value θ4, and the angle range that is smaller than the third threshold vale θ3 and larger than the fourth threshold value θ4. In other words, with respect to the line segments whose advancing direction is relatively close to the advancing direction of the particular line segment, the highest priority is given to the line segment whose starting point is in a direction close to the advancing direction of the particular line segment with respect to the ending point of the particular line segment. The second priority is given to the line segment whose starting point is in a direction close to the direction opposite to the advancing direction with respect to the ending point of the particular line segment. Then, the lowest priority is given to the line segment whose starting point is in a direction relatively close to the direction perpendicular to the particular line segment.

This is because, if a stitch is formed along the advancing direction and thereafter the next stitch is formed along an almost same advancing direction, the closer the first needle drop point (corresponding to the starting point of the line segment) of the next stitch is to the advancing direction of the preceding formed stitch, the more naturally the stitches are continued, resulting in a good appearance. Further, this is because, rather than a case in which the first needle drop point of the next stitch is in the direction perpendicular to the preceding stitch, when the first needle drop point of the next stitch is close to the direction opposite to the advancing direction of the preceding stitch, a stitch that connects the two stitches tends not to stand out.

In a similar manner, taking the appearance of stitches into consideration, in the angle difference range 2, the priority order is set in the following order: the angle range that is equal to or smaller than the fourth threshold value θ4, the angle range that is equal to or larger than the third threshold value θ3, and the angle range that is smaller than the third threshold value θ3 and larger than the fourth threshold value θ4. In other words, with respect to the line segments whose advancing direction is relatively close to the direction opposite to the advancing direction of the particular line segment, the highest priority is given to the line segment whose starting point is in a direction close to the direction opposite to the advancing direction of the particular line segment with respect to the ending point of the particular line segment. The second priority is given to the line segment whose starting point is in a direction close to the advancing direction with respect to the ending point of the particular line segment. Then, the lowest priority is given to the line segment whose starting point is in a direction relatively close to the direction perpendicular to the particular line segment.

Further, for similar reasons, in the angle difference range 3, the priority order is set in the following order: the angle range that is equal to or larger than the third threshold value θ3, the angle range that is smaller than the third threshold value θ3 and larger than the fourth threshold value θ4, and the angle range that is equal to or smaller than the fourth threshold value θ4. In other words, with respect to the line segments whose advancing direction is relatively close to the direction perpendicular to the particular line segment, the highest priority is given to the line segment whose starting point is in a direction close to the advancing direction of the particular line segment with respect to the ending point of the particular line segment. The second priority is given to the line segment whose starting point is in a direction relatively close to the direction perpendicular to the particular line segment. The lowest priority is given to the line segment whose starting point is in a direction close to the direction opposite to the advancing direction with respect to the ending point of the particular line segment.

Figure 7:
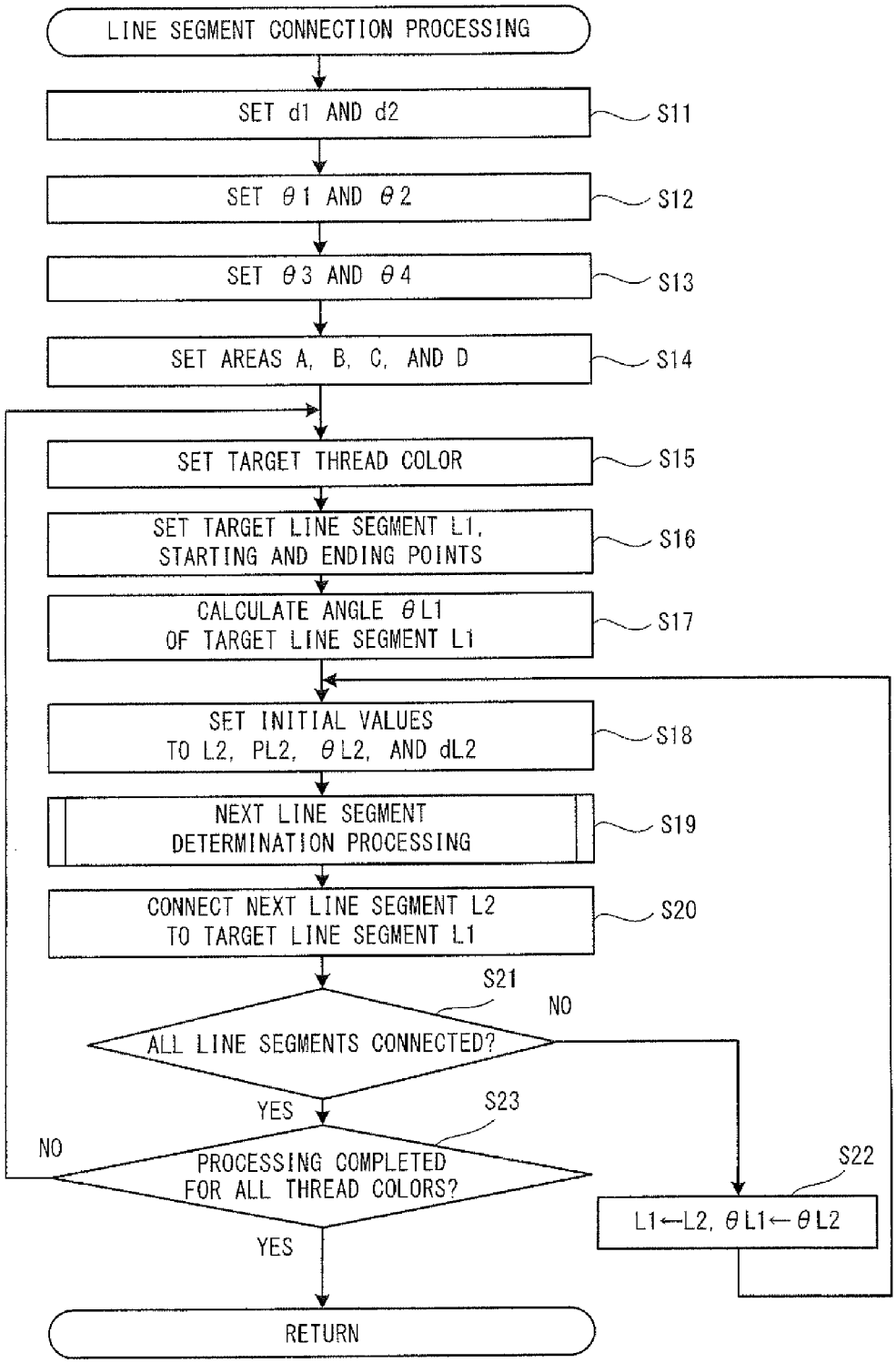
FIG. 7 is a flowchart of line segment connection processing.

The content of the line segment connection processing that is performed at step S5 of the embroidery data creation processing (refer to FIG. 3) will be explained with reference to FIGS. 7 to 12. As shown in FIG. 7, first, the CPU 11 sets the first distance d1 and the second distance d2 that define the distance ranges (step S11). The first distance d1 and the second distance d2 may be values input from the keyboard 21 by the user, or may be values that are determined in advance and stored in the setting value storage area 154 of the HDD 15. The first distance d1 and the second distance d2 are set to appropriate values in accordance with the length of the line segments arranged at step S3. For example, when the length of the line segments set at step S3 is 3 mm, it is desirable that the first distance d1 and the second distance d2 are set to approximately 1 mm and 2 mm, respectively.

The CPU 11 sets the first threshold value θ1 and the second threshold value θ2 that define the angle difference ranges (step S12). The first threshold value θ1 and the second threshold value θ2 may be values input from the keyboard 21 by the user, or may be values that are determined in advance and stored in the setting value storage area 154 of the HDD 15. Both the first threshold value θ1 and the second threshold value θ2 are values that are larger than 0 degrees and smaller than 90 degrees. The CPU 11 sets the third threshold value θ3 and the fourth threshold value θ4 that define the angle ranges (step S13). The third threshold value θ3 and the fourth threshold value θ4 may be values input from the keyboard 21 by the user, or may be values that are determined in advance and stored in the setting value storage area 154 of the HDD 15. The third threshold value θ3 is a value that is equal to or larger than 90 degrees and smaller than 180 degrees. The fourth threshold value θ4 is a value that is larger than 0 degrees and smaller than 90 degrees.

The CPU 11 sets the areas A to D (refer to FIG. 4) based on the first distance d1 and the second distance d2 that have been set at step S11 and on the third threshold value θ3 and the fourth threshold value θ4 that have been set at step S13 (step S14).

Next, the CPU 11 performs processing that sequentially connects the line segments having the same thread color determined at step S4, for each thread color (steps S15 to S23). First, the CPU 11 sets a thread color that is used as a processing target (hereinafter referred to as a target thread color) from unprocessed thread colors among the N thread colors (step S15). The CPU 11 refers to the line segment data and sets a line segment that is used as a processing target (hereinafter referred to as a target line segment L1) from unprocessed line segments among the line segments of the target thread color. Further, the CPU 11 sets one of the two endpoints of the target line segment L1 as the starting point, and sets the other endpoint as the ending point (step S16). Both the endpoints of the target line segment L1 that has been firstly set are not connected to another line segment. In this case, the CPU 11 may set any line segment as the target line segment L1, and may set either one of the two endpoints as the starting point. For example, among the line segments of the target thread color that are arranged in an area corresponding to the original image, the CPU 11 may set the line segment having an endpoint whose X coordinate and Y coordinate are each closest to zero as the target line segment L1, and may set the endpoint as the starting point.

The CPU 11 calculates an angle θL1 of the target line segment L1 (step S17). As described above, the XY coordinates of the endpoints of all the line segments can be identified by the line segment data created at step S3 (refer to FIG. 3). For example, Japanese Laid-Open Patent Publication No. 2010-131272 (US Patent Application Publication No. 2010/0145494) discloses a method of calculating an angle of a target line segment, the relevant portions of which are incorporated by reference. Specifically, the CPU 11 may calculate the arctangent based on the coordinate position (x0, y0) of the starting point of the target line segment L1 and the coordinate position (x1, y1) of the ending point of the target line segment L1, and may determine the angle θL1 depending on which quadrant the ending point is located in with respect to the starting point. Alternatively, the CPU 11 may directly use, as the angle θL1, the angle characteristic calculated at step S2 for a pixel that corresponds to the center of the target line segment L1.

The CPU 11 sets initial values indicating "not set" as values that respectively indicate a next line segment L2, a priority PL2 of the next line segment L2, an angle θL2 of the next line segment L2, and a distance dL2 between the ending point of the target line segment L1 and the starting point of the next line segment L2, and stores the initial values in the RAM 12 (S18). The next line segment L2 is a line segment that is determined as a line segment to be connected to the target line segment L1. The CPU 11 performs next line segment determination processing that determines the next line segment L2 from among the line segments of the target thread color (step S19). The next line segment determination processing will be described below.

The CPU 11 connects the next line segment L2 determined by the next line segment determination processing to the target line segment L1, creates connection line segment data and stores the connection line segment data in the RAM 12 (step S20). Specifically, the CPU 11 connects the coordinate data of the starting point and the ending point of the next line segment L2 to the coordinate data of the starting point and the ending point of the target line segment L1, thus creating the connection line segment data. The CPU 11 determines whether all the line segments of the target thread color have been connected (step S21). In a case where there is a line segment that has not been connected (no at step S21), the CPU 11 sets the next line segment L2 as the target line segment L1 that is to be the next processing target, and sets the angle θL2 of the next line segment L2 as the angle θL1 of the target line segment L1 (step S22). The CPU 11 returns the processing to step S18.

In a case where the connection of all the line segments of the target thread color has not been completed (no at step S21), the CPU 11 repeats the processing from steps S18 to S22. In a case where all the line segments of the target thread color have been connected (yes at step S21), the CPU 11 determines whether the processing has been completed for all the N thread colors (step S23). In a case where there is a thread color for which the processing has not been performed (no at step S23), the CPU 11 returns the processing to step S15, and sets the target thread color that is to be the next processing target, from among the thread colors for which the processing has not been performed. In a case where the processing has not been completed for all the N thread colors (no at step S23), the CPU 11 repeats the processing from steps S15 to S23. In a case where the processing has been completed for all the N thread colors (yes at step S23), the CPU 11 ends the line segment connection processing and returns the processing to the embroidery data creation processing shown in FIG. 3.

Figure 8:
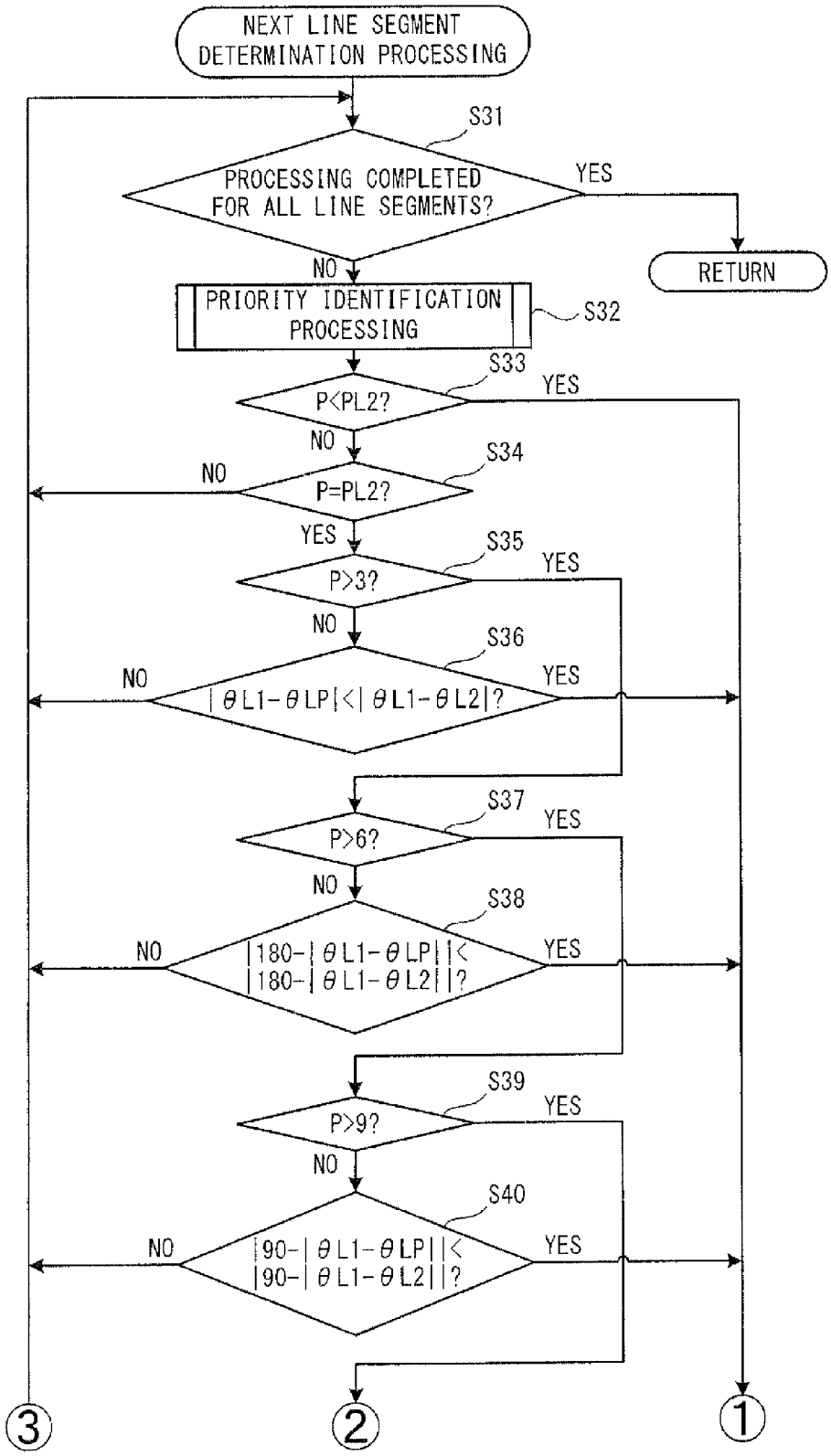
FIG. 8 is a flowchart of next line segment determination processing.
Figure 9:
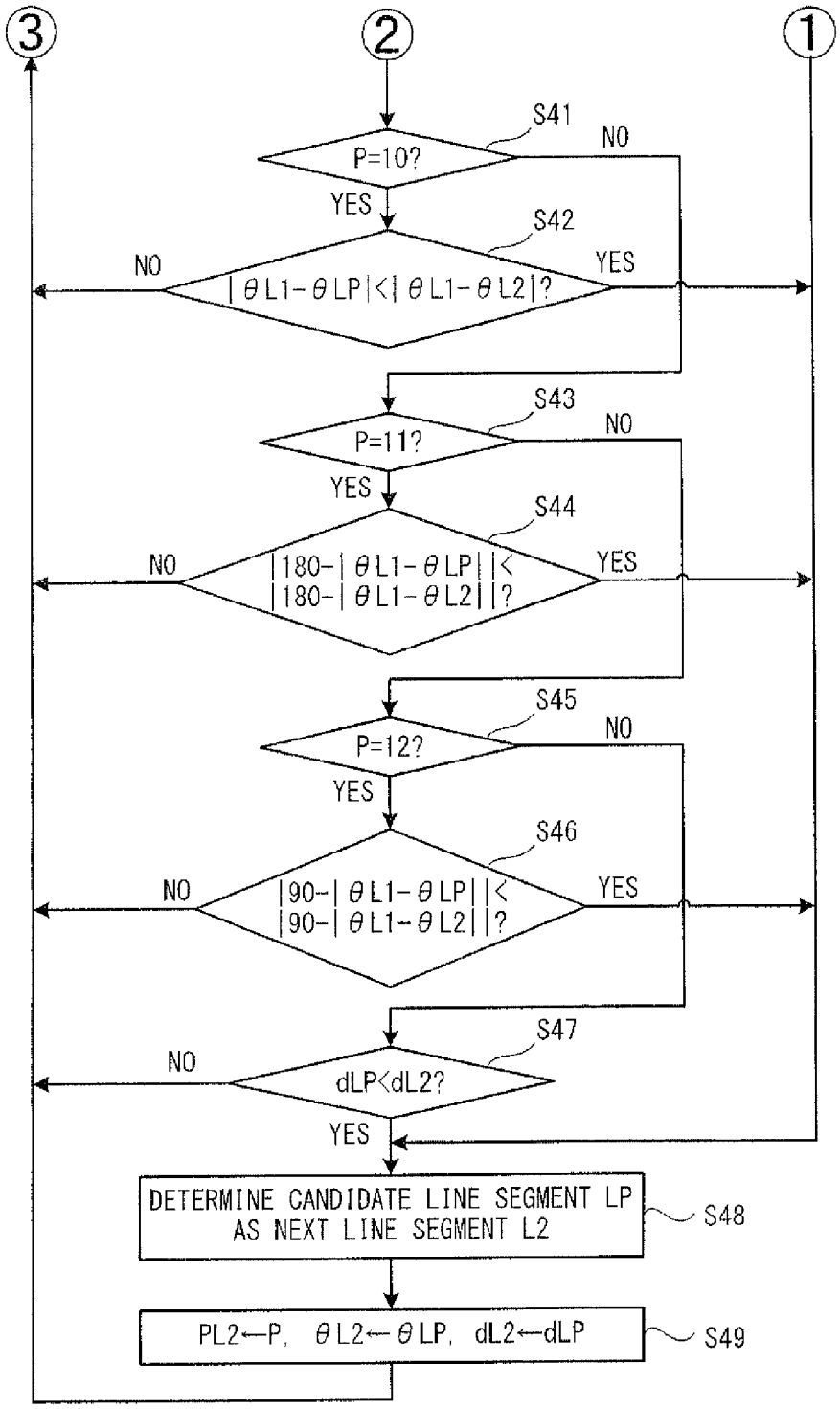
FIG. 9 is a flowchart of the next line segment determination processing, and is a continuation of FIG. 8.

The content of the next line segment determination processing will be explained with reference to FIG. 8 to FIG. 12. As shown in FIG. 8, first, the CPU 11 determines whether the processing has been completed for all the line segments that are not connected to another line segment, among the line segments of the target thread color (step S31). In a case where there is a line segment that has not been processed (no at step S31), the CPU 11 performs priority identification processing that identifies the priority of a candidate line segment LP, in accordance with the above-described priority order (step S32, FIGS. 10 and 11). The candidate line segment LP is a line segment that is identified as a target of determination as to whether or not to be set as the next line segment L2, among the line segments of the target thread color.

Figure 10:
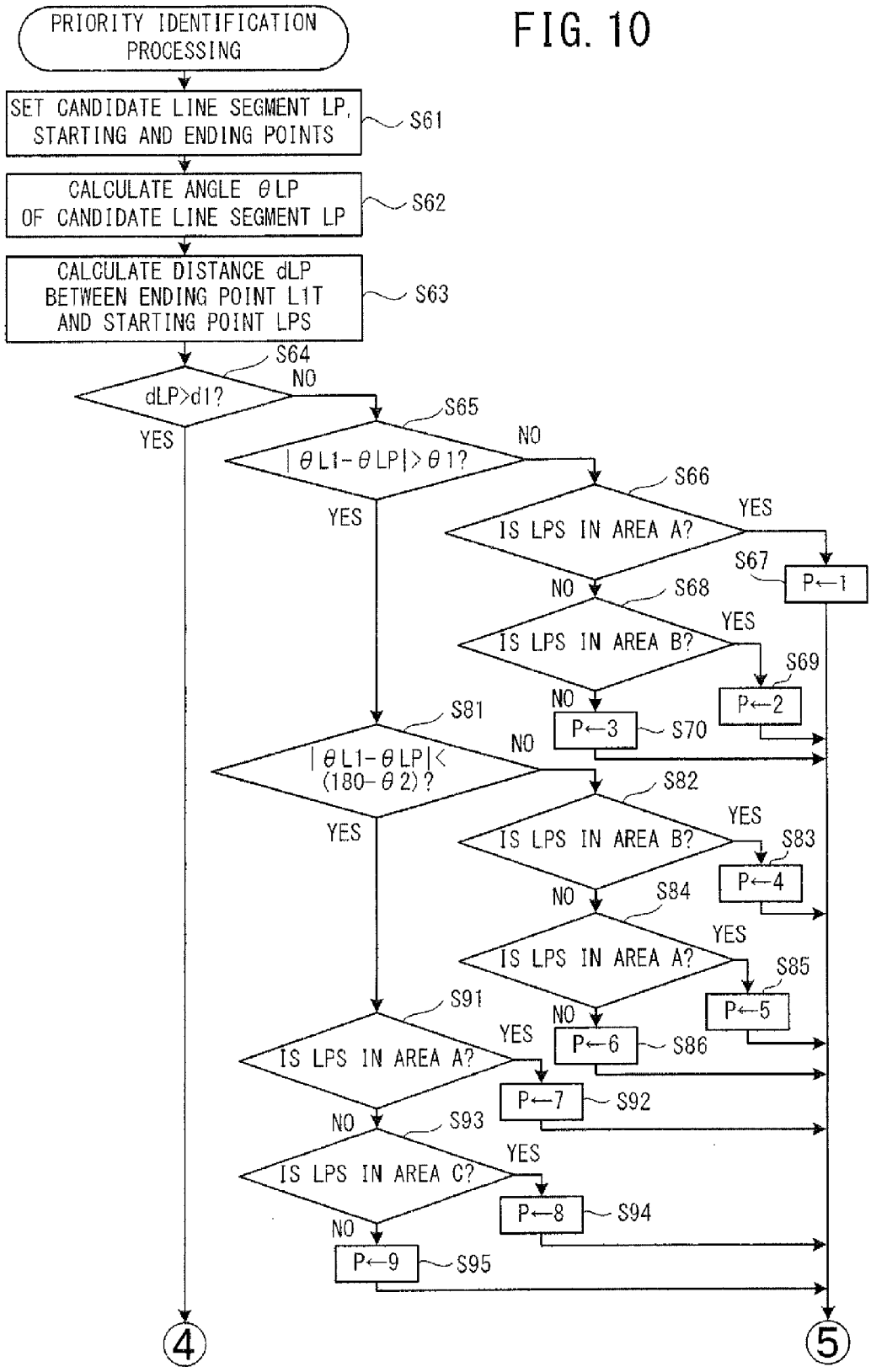
FIG. 10 is a flowchart of priority identification processing.
Figure 11:
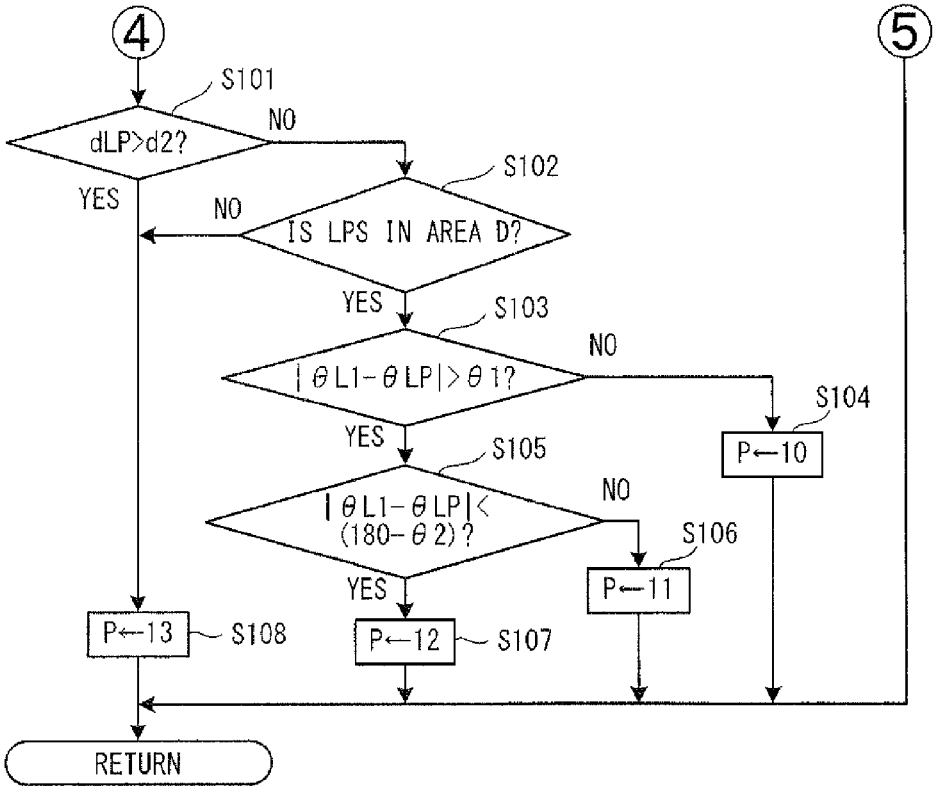
FIG. 11 is a flowchart of the priority identification processing, and is a continuation of FIG. 10.

As shown in FIG. 10, in the priority identification processing, first, the CPU 11 sets, from among the line segments of the target thread color, a line segment for which the determination as to whether or not to be set as the next line segment L2 has not been performed, as the candidate line segment LP. Then, among the two endpoints of the candidate line segment LP, the CPU 11 sets the endpoint that is closer to the ending point of the target line segment L1 as the starting point of the candidate line segment LP, and sets the other endpoint as the ending point of the candidate line segment LP (step S61). The CPU 11 calculates an angle θLP of the candidate line segment LP, using the same method as that used to calculate the angle θL1 of the target line segment L1 at step S17 (refer to FIG. 7) (step S62). Further, based on the line segment data of the target line segment L1 and the candidate line segment LP, the CPU 11 calculates a distance dLP between the ending point of the target line segment L1 (hereinafter referred to as an ending point L1T) and the starting point of the candidate line segment LP (hereinafter referred to as the starting point LPS) (step S63). In a case where the first distance d1 and the second distance d2 are set in units of millimeters as described above, the distance dLP is calculated as a distance in units of millimeters when the target line segment L1 and the candidate line segment LP are converted into actual stitches.

Figure 12:
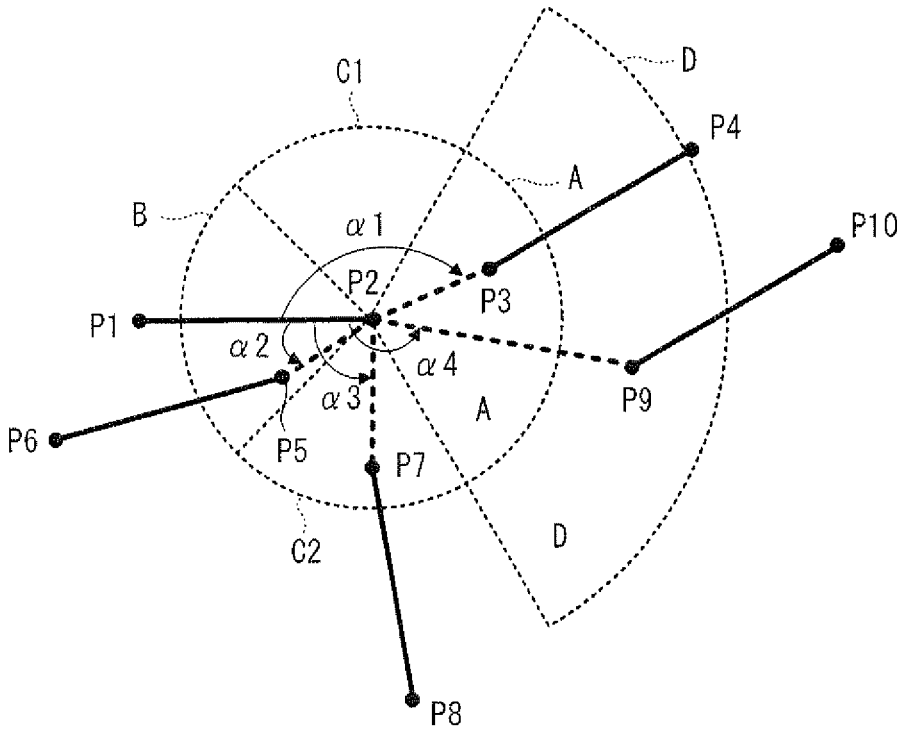
FIG. 12 is a diagram exemplifying positional relationships between a target line segment and other line segments.

Next, the CPU 11 performs processing that identifies the priority of the candidate line segment LP in the above-described pre-set priority order (refer to FIG. 6) (steps S64 to S108). In the explanation below, an example is used in which the line segment P1P2 shown in FIG. 12 is set as the target line segment L1 and there are line segments P3P4, P5P6, P7P8, and P9P10 that have the same color as the line segment P1P2. The areas A to D shown in FIG. 12 are set under the same conditions as the example shown in FIG. 4. Further, the angles of the line segments P1P2, P3P4, P5P6, P7P8, and P9P10 are 0 degrees, 30 degrees, −165 degrees, −80 degrees, and 30 degrees, respectively. With respect to the angle difference ranges 1 to 3, it is assumed that the first threshold value θ1 and the second threshold value θ2 are set to 45 degrees.

As shown in FIG. 12, starting points P3, P 5, and P7 of the line segments P3P4, P5P6, and P7P8 are each located within the first distance d1 from the ending point P2 of the line segment P1P2. Further, an angle α1 that is formed by the line segment P1P2 and a line segment P2P3 (a line segment connecting the ending point P2 and the starting point P3) is larger than θ3. Therefore, the starting point P3 is within the area A. An angle a2 that is formed by the line segment P1P2 and a line segment P2P5 (a line segment connecting the ending point P2 and the starting point P5) is smaller than θ4. Therefore, the starting point P5 is within the area B. An angle a3 that is formed by the line segment P1P2 and a line segment P2P7 (a line segment connecting the ending point P2 and the starting point P7) is larger than θ4 and smaller than θ3. Therefore, the starting point P7 is within the area C. The line segment P9P10 has a starting point P9 in a position that is within the second distance d2 from the ending point P2 of the line segment P1P2 and is separated further than the first distance d1 from the ending point P2. An angle a4 that is formed by the line segment P1P2 and a line segment P2P9 (a line segment connecting the ending point P2 and the starting point P9) is larger than θ3. Therefore, the starting point P9 is within the area D.

As shown in FIG. 10, the CPU 11 determines whether the distance dLP is larger than the first distance d1 (step S64). In a case where one of the line segments P3P4, P5P6, and P7P8 shown in FIG. 12 is the candidate line segment LP, the distance dLP is not larger than the first distance d1 (no at step S64). In this type of case, the CPU 11 calculates an absolute value (|θL1−θLP|) of an angle difference between the angle θL1 of the target line segment L1 and the angle θLP of the candidate line segment LP, and determines whether the absolute value is larger than the first threshold value θ1 (step S65).

For example, when the line segment P3P4 shown in FIG. 12 is the candidate line segment LP, the absolute value of the angle difference between the line segment P1P2 and the line segment P3P4 is 30 degrees. This angle difference is not larger than 45 degrees, which is the first threshold value θ1 (no at step S65). In this type of case, the CPU 11 determines whether the starting point LPS of the candidate line segment LP is within the area A (step S66). In a case where the line segment P3P4 is the candidate line segment LP, the starting point P3 is within the area A (yes at step S66). This case corresponds to the combination of the angle difference range 1 and the area A. Therefore, according to the priority order (refer to FIG. 6), the CPU 11 sets 1 as a priority P of the candidate line segment LP, and stores 1 as the priority P in the RAM 12 (step S67).

A case in which the starting point LPS of the candidate line segment LP is not within the area A (no at step S66) but within the area B (yes at step S68) corresponds to the combination of the angle difference range 1 and the area B. Therefore, the CPU 11 sets 2 as the priority P of the candidate line segment LP, and stores 2 as the priority P in the RAM 12 (step S69). A case in which the starting point LPS of the candidate line segment LP is not within the area B (no at step S68) but is within the area C corresponds to the combination of the angle difference range 1 and the area C. Therefore, the CPU 11 sets 3 as the priority P of the candidate line segment LP and stores 3 as the priority P in the RAM 12 (step S70).

When the absolute value of the angle difference between the angle θL1 and the angle θLP is larger than the first threshold value θ1 (yes at step S65), the CPU 11 determines whether the absolute value of the angle difference is smaller than the value (180−θ2) obtained by subtracting the second threshold value θ2 from 180 degrees (step S81). For example, when the line segment P5P6 shown in FIG. 12 is the candidate line segment LP, the absolute value of the angle difference between the line segment P1P2 and the line segment P5P6 is 165 degrees. This angle difference is not smaller than 135 degrees obtained by subtracting 45 degrees, which is the second threshold value θ2, from 180 degrees (no at step S81). In this type of case, the CPU 11 determines whether or not the starting point LPS of the candidate line segment LP is within the area B (step S82). When the line segment P5P6 is the candidate line segment LP, the starting point P5 is within the area B (yes at step S82). This case corresponds to the combination of the angle difference range 2 and the area B. Therefore, the CPU 11 sets 4 as the priority P of the candidate line segment LP and stores 4 as the priority P in the RAM 12 (step S83).

A case in which the starting point LPS of the candidate line segment LP is not within the area 13 (no at step S82) but within the area A (yes at step S84) corresponds to the combination of the angle difference range 2 and the area A. Therefore, the CPU 11 sets 5 as the priority P of the candidate line segment LP and stores 5 as the priority P in the RAM 12 (step S85). A case in which the starting point LPS of the candidate line segment LP is also not within the area A (no at step S84) but is within the area C corresponds to the combination of the angle difference range 2 and the area C. Therefore, the CPU 11 sets 6 as the priority P of the candidate line segment LP and stores 6 as the priority P in the RAM 12 (step S86).

For example, in a case where the line segment P7P8 shown in FIG. 12 is the candidate line segment LP, the absolute value of the angle difference between the line segment P1P2 and the line segment P7P8 is 80 degrees. This angle difference is smaller than 135 degrees obtained by subtracting 45 degrees, which is the second threshold value θ2, from 180 degrees (yes at step S81). In this type of case, the CPU 11 determines whether the starting point LPS of the candidate line segment LP is within the area A (step S91). A case in which the starting point LPS is within the area A (yes at step S91) corresponds to the combination of the angle difference range 3 and the area A. Therefore, the CPU 11 sets 7 as the priority P of the candidate line segment LP and stores 7 as the priority P in the RAM 12 (step S92).

In a case where the line segment P7P8 is the candidate line segment LP, the starting point P7 is not within the area A (no at step S91) but is within the area C (yes at step S93). This case corresponds to the combination of the angle difference range 3 and the area C. In this type of case, the CPU 11 sets 8 as the priority P of the candidate line segment LP and stores 8 as the priority P in the RAM 12 (step S94). A case in which the starting point LPS of the candidate line segment LP is also not within the area C (no at step S93) but is within the area B corresponds to the combination of the angle difference range 3 and the area B. Therefore, the CPU 11 sets 9 as the priority P of the candidate line segment LP and stores 9 as the priority P in the RAM 12 (step S95).

In a case where the distance dLP is larger than the first distance d1 (yes at step S64), the CPU 11 determines whether the distance dLP is larger than the second distance d2 (step S101). For example, when the line segment P9P10 shown in FIG. 12 is the candidate line segment LP, the distance dLP is larger than the first distance d1 and equal to or smaller than the second distance d2 (no at step S101). In this type of case, the CPU 11 determines whether the starting point LPS of the candidate line segment LP is within the area D (step S102). In a case where the line segment P9P10 is the candidate line segment LP, the starting point P9 is within the area D (yes at step S102). In this type of case, the CPU 11 determines whether the absolute value of the angle difference between the angle θL1 and the angle θLP is larger than the first threshold value θ1 (step S103). On the other hand, in a case where the starting point LPS of the candidate line segment LP is not within the area D (no at step S102), the CPU11 advances the processing to step S108.

In a case where the line segment P9P10 is the candidate line segment LP, the absolute value of the angle difference between the line segment P1P2 and the line segment P9P10 is 30 degrees. This angle difference is not larger than 45 degrees, which is the first threshold value θ1 (no at step S103). This case corresponds to the combination of the angle difference range 1 and the area D. Therefore, the CPU 11 sets 10 as the priority P of the candidate line segment LP and stores 10 as the priority P in the RAM 12 (step S104).

In a case where the absolute value of the angle difference between the angle θL1 and the angle θLP is larger than the first threshold value θ1 (yes at step S103), the CPU 11 determines whether the absolute value of the angle difference is smaller than the value (180−θ2) obtained by subtracting the second threshold value θ2 from 180 degrees (step S105). A case in which the absolute value of the angle difference is not smaller than the value (180−θ2) (no at step S105) corresponds to the combination of the angle difference range 2 and the area D. Therefore, the CPU 11 sets 11 as the priority P of the candidate line segment LP and stores 11 as the priority P in the RAM 12 (step S106). A case in which the absolute value of the angle difference is smaller than the value (180−θ2) (yes at step S105) corresponds to the combination of the angle difference range 3 and the area D. Therefore, the CPU 11 sets 12 as the priority P of the candidate line segment LP and stores 12 as the priority P in the RAM 12 (step S107).

In a case where the distance dLP is larger than the second distance d2 (yes at step S101), the starting point LPS of the candidate line segment LP is not within any one of the areas A to D. Therefore, the CPU 11 sets 13 as the priority P of the candidate line segment LP and stores 13 as the priority P in the RAM 12 (step S108). In the above-described processing, the CPU 11 sets one of the values 1 to 13 as the priority P of the candidate line segment LP in accordance with the priority order set in advance. After that, the CPU 11 ends the priority identification processing, and returns the processing to the next line segment determination processing shown in FIG. 8.

The CPU 11 determines whether the value of the priority P of the candidate line segment LP identified by the priority identification processing is smaller than the value of the priority PL2 of the next line segment L2 (step S33). In the first processing, in a case where the value of the priority PL2 of the next line segment L2 is the initial value indicating "not set," the CPU 11 determines that the value of the priority P is smaller than the value of the priority PL2 (yes at step S33). In this case, the CPU 11 determines the candidate line segment LP as the next line segment L2, and stores the line segment data of the next line segment L2 in the RAM 12 (step S48). The CPU 11 sets the value of the priority P of the candidate line segment LP as the value of the priority PL2 of the next line segment L2, sets the value indicating the angle θLP of the candidate line segment LP as the value indicating the angle θL2 of the next line segment L2, and sets the distance dLP as the distance dL2 (step S49). The CPU 11 returns the processing to step S31.

In a case where the processing has not been completed for all the line segments (no at step S31), the CPU 11 performs the priority identification processing, newly sets the candidate line segment LP, and identifies the priority P of the candidate line segment LP (step S32). In this case, at step S33, it is determined whether the priority P of the candidate line segment LP is higher than the priority PL2 of the next line segment L2 determined by the preceding processing. The higher the priority is, the smaller the value of each of the priority PL2 of the next line segment L2 and the priority P of the candidate line segment LP is. Therefore, when the value of the priority P of the candidate line segment LP is smaller than the value of the priority PL2 of the next line segment L2 (yes at step S33), the CPU 11 determines the candidate line segment LP as the next line segment L2. Then, the CPU 11 updates the line segment data stored in the RAM 12 to the line segment data of the newly determined next line segment L2 (step S48). After the CPU 11 performs the processing at step S49 as described above, the CPU 11 returns the processing to step S31.

When the value of the priority P of the candidate line segment LP is not smaller than the value of the priority PL2 of the next line segment L2 (no at step S33), the CPU 11 determines whether the value of the priority P of the candidate line segment LP is equal to the value of the priority PL2 of the next line segment L2, namely, whether the candidate line segment LP has the same priority as the next line segment L2 (step S34). In a case where the value of the priority P of the candidate line segment LP is not equal to the value of the priority PL2 of the next line segment L2 (no at step S34), the priority P of the candidate line segment LP is lower than the priority PL2 of the next line segment L2 determined by the preceding processing. Therefore, there is no need to update the next line segment L2 and the CPU 11 returns the processing to step S31.

In a case where the value of the priority P of the candidate line segment LP is equal to the value of the priority PL2 of the next line segment L2 (yes at step S34), the candidate line segment LP has the same priority as the next line segment L2. Therefore, the CPU 11 performs processing that updates the next line segment L2 as appropriate according to the priority P (steps S35 to S47).

Specifically, in a case where the value of the priority P is not larger than 3 (no at step S35), namely, when the priority P takes one of the values 1 to 3, the angle difference between the target line segment L1 and the candidate line segment LP belongs to the angle difference range 1. Therefore, in order to form more natural stitches, it is preferable to set, as the next line segment L2, a line segment whose angle is close to the angle of the target line segment L1, namely, a line segment for which the absolute value of the angle difference is smaller. Therefore, the CPU 11 calculates the absolute value (|θL1−θLP|) of the angle difference between the angle OLI and the angle θLP and the absolute value (|θL1−θL2|) of the angle difference between the angle θL1 and the angle θL2, based on the angle θL1 of the target line segment L1, the angle θL2 of the next line segment L2, and the angle θLP of the candidate line segment LP, which have been calculated by the earlier processing steps.

In a case where the absolute value of the angle difference between the angle θL1 and the angle θLP is smaller than the absolute value of the angle difference between the angle θL1 and the angle θL2 (yes at step S36), the CPU 11 determines the candidate line segment LP as the next line segment L2 (step S48). In a case where the absolute value of the angle difference between the angle θL1 and the angle θLP is not smaller than the absolute value of the angle difference between the angle θL1 and the angle θL2 (no at step S36), there is no need to update the next line segment L2. Therefore, the CPU 11 returns the processing to step S31.

In a case where the value of the priority P is larger than 3 (yes at step S35) and not larger than 6 (no at step S37), namely, when the priority P takes one of the values 4 to 6, the angle difference between the target line segment L1 and the candidate line segment LP belongs to the angle difference range 2. Therefore, in order to form more natural stitches, it is preferable to set, as the next line segment L2, a line segment whose advancing direction is close to the direction opposite to the advancing direction of the target line segment L1, namely, a line segment for which the absolute value of the angle difference is close to 180 degrees. Therefore, the CPU 11 calculates the absolute value (|180−|θL1−θLP||) of the value obtained by subtracting the absolute value of the angle difference between the angle θL1 and the angle θLP from 180 degrees, and the absolute value (|180−|θL1−θL2|) of the value obtained by subtracting the absolute value of the angle difference between the angle θL1 and the angle θL2 from 180 degrees.

In a case where the value |180−|θL1−θLP|| is smaller than the value |180−|θL1−θL2|| (yes at step S38), the CPU 11 determines the candidate line segment LP as the next line segment L2 (step S48). In a case where the value |180−|θL1−θLP|| is not smaller than the value |180−|θL1−θL2|| (no at step S38), there is no need to update the next line segment L2. Therefore, the CPU 11 returns the processing to step S31.

In a case where the value of the priority P is larger than 6 (yes at step S37) and not larger than 9 (no at step S39), namely, in a case where the priority P takes one of the values 7 to 9, the angle difference between the target line segment L1 and the candidate line segment LP belongs to the angle difference range 3. Therefore, in order to form more natural stitches, it is preferable to set, as the next line segment L2, a line segment whose advancing direction is close to the direction perpendicular to the target line segment L1, namely, a line segment for which the absolute value of the angle difference is close to 90 degrees. Therefore, the CPU 11 calculates the absolute value (|90−θL1−θLP|) of the value obtained by subtracting the absolute value of the angle difference between the angle θL1 and the angle θLP from 90 degrees, and the absolute value (|90−|θL1−θL2||) of the value obtained by subtracting the absolute value of the angle difference between the angle θL1 and the angle θL2 from 90 degrees.

In a case where the value |90−|θL1−θLP|| is smaller than the value |90−|θL1−θL2|| (yes at step S40), the CPU 11 determines the candidate line segment LP as the next line segment L2 (step S48). In a case where the value |90−θL1−θLP|| is not smaller than the value |90−|θL1−θL2|| (no at step S40), there is no need to update the next line segment L2. Therefore, the CPU 11 returns the processing to step S31.

In a case where the value of the priority P is larger than 9 (yes at step S39) and equal to 10 (yes at step S41), the angle difference between the target line segment L1 and the candidate line segment LP belongs to the angle difference range 1. Therefore, in a case where the value |θL1−θLP| is smaller than the value |θL1−θL2| (yes at step S42), the CPU 11 determines the candidate line segment LP as the next line segment L2 (step S48). In a case where the value |θL1−θLP| is not smaller than the value |θL1−θL2| (no at step S42), the CPU 11 returns the processing to step S31.

In a case where the value of the priority P is not 10 (no at step S41) but 11 (yes at step S43), the angle difference between the target line segment L1 and the candidate line segment LP belongs to the angle difference range 2. Therefore, when the value |180−θL1−θLP|| is smaller than the value |180−|θL1−θL2|| (yes at step S44), the CPU 11 determines the candidate line segment LP as the next line segment L2 (step S48). In a case where the value |180−|θL1−θLP|| is not smaller than the value |180−|θL1−θL2|| (no at step S44), the CPU 11 returns the processing to step S31.

In a case where the value of the priority P is not 11 (no at step S43) but 12 (yes at step S45), the angle difference between the target line segment L1 and the candidate line segment LP belongs to the angle difference range 3. Therefore, in a case where the value |90−|θL1−θLP|| is smaller than the value |90−|θL1−θL2|| (yes at step S46), the CPU 11 determines the candidate line segment LP as the next line segment L2 (step S48). In a case where the value |90−|θL1−θLP|| is not smaller than the value |90−|θL1−θL2|| (no at step S46), the CPU 11 returns the processing to step S31.

In a case where the value of the priority P is not 12 (no at step S45), the value of the priority P is 13. Therefore, in order to form more natural stitches, it is preferable to set, as the next line segment L2, a line segment having the starting point that is closer to the ending point of the target line segment L1. Therefore, in a case where the distance dLP is smaller than the distance dL2 (yes at step S47), the CPU 11 determines the candidate line segment LP as the next line segment L2 (step S48). In a case where the distance dLP is not smaller than the distance dL2 (no at step S47), the CPU 11 returns the processing to step S31. The CPU 11 repeats the above-described processing. In a case where the processing has been completed for all the line segments of the target thread color (yes at step S31), the CPU 11 ends the next line segment determination processing and returns the processing to the line segment connection processing shown in FIG. 7.

As described above, in the present embodiment, the CPU 11 sequentially connects the plurality of line segments arranged in the area corresponding to the original image, in accordance with the priority order (refer to FIG. 6) that is based on the distance between the ending point L1T of the target line segment L1 and the starting point LPS of the candidate line segment LP, the angle difference between the target line segment L1 and the candidate line segment LP, and the angle formed by the target line segment L1 and the line segment connecting the ending point L1T and the starting point LPS. It is therefore possible to create the embroidery data that is used to form continuous stitches that can naturally express an embroidery pattern.

Generally, when the second needle drop point of the first stitch and the first needle drop point of the second stitch are separated from each other by a certain distance or more, it is not preferable to continuously sew the first stitch and the second stitch because it adversely affects the appearance of the embroidery pattern. Therefore, a space between the first stitch and the second stitch is connected by a jump stitch that is cut and removed afterward. The more the jump stitches are used, the more the sewing quality deteriorates. Therefore, it is preferable to suppress generation of the jump stitches as much as possible. According to the line segment connection processing of the present embodiment, in a case where a plurality of line segments whose angles are not so close are located in proximity to each other, in comparison to a method that connects line segments for which the distance between the ending point L1T and the starting point LPS is within a predetermined range and the angle difference between the target line segment L1 and the candidate line segment LP is within a predetermined range, it is possible to connect more line segments for which the distance between the ending point LIT and the starting point LPS is within the predetermined range, in accordance with the priority order. As a result, it is possible to reduce the jump stitches during embroidery sewing.

In the present embodiment, more stitches are continuously formed, and there is a possibility that the number of stitches is increased. However, on the other hand, when the jump stitches are generated, the CPU 11 creates, in the embroidery data creation processing (step S6 in FIG. 3), the embroidery data that causes the sewing machine 3 to execute processing that performs a reinforcement stitching operation after the needle has pierced the second needle drop point of the first stitch. The reinforcement stitching operation includes stopping and restarting the up-down movement of the needle bar 35. Therefore, a time period that is required as a result of a slight increase in the number of stitches may be offset by a time period that is required for the reinforcement stitching operation. As a result, there may be almost no change in the entire time period required to sew the embroidery pattern. In other words, it is possible to reduce the jump stitches without deteriorating work efficiency.

Various changes can be made in the above-described embodiment. For example, the priority order when determining another line segment (the next line segment L2) to be connected to the particular line segment (the target line segment L1) need not necessarily limited to the example (refer to FIG. 6) described in the above-described embodiment. Specifically, a plurality of distance ranges, a plurality of angle difference ranges, and a plurality of angle ranges that are different from those of the above-described embodiment may be set for the above-described three conditions (the distance between the ending point of the particular line segment and the starting point of the other line segment, the angle difference between the particular line segment and the other line segment, and the angle formed by the particular line segment and the line segment connecting the ending point of the particular line segment and the starting point of the other line segment). Further, a priority order different from that of the above-described embodiment may be set for the plurality of combinations in which one of the plurality of distance ranges, one of the plurality of angle difference ranges, and one of the plurality of angle ranges are combined.

For example, in the above-described embodiment, the priority of the combination of the distance range that is larger than the first distance d1 and equal to or smaller than the second distance d2 and the angle range that is equal to or larger than the third threshold value θ3 is 10 to 12 in the priority order. This priority is higher than the priority (13 in the priority order) of the combination of the distance range that is larger than the first distance d1 and equal to or smaller than the second distance d2 and the other two types of angle ranges. Further, the priority of the combination of the distance range that is larger than the first distance d1 and equal to or smaller than the second distance d2 and the other two types of angle ranges is 13, which is the same as the priority of all the combinations including the distance range that is larger than the second distance d2.

Figure 13:
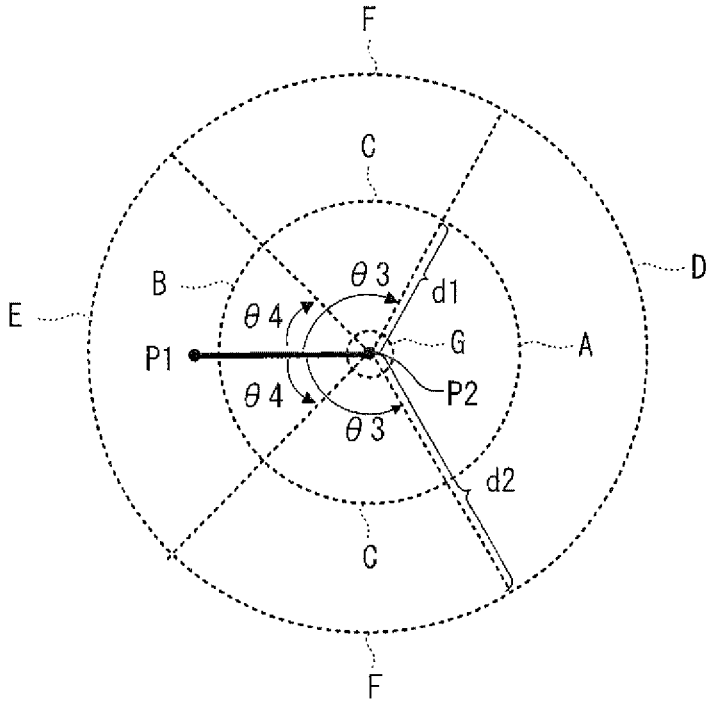
FIG. 13 is an explanatory diagram of areas A, B, C, D, E, F, and G according to a modified example.

In contrast to this, as shown in FIG. 13, for example, the areas corresponding to the combinations of the distance range and the angle range may be increased to six types of areas A to F. In this case, the combination of the distance range that is larger than the first distance d1 and equal to or smaller than the second distance d2 and the angle range that is equal to or larger than the third threshold value θ3 corresponds to the area D. The combination of the distance range that is larger than the first distance d1 and equal to or smaller than the second distance d2 and the angle range that is equal to or smaller than the fourth threshold value θ4 corresponds to the area E. The combination of the distance range that is larger than the first distance d1 and equal to or smaller than the second distance d2 and the angle range that is smaller than the third threshold value θ3 and larger than the fourth threshold value θ4 corresponds to the area F. Then, for a plurality of combinations in which one of the areas A to F and one of the three types of angle difference ranges are combined, the priority order may be set based on the similar idea as the above-described embodiment. Further, an area G that is within a distance shorter than the first distance d1 from the ending point of the particular line segment (the ending point P2 of the line segment P1P2 in the example shown in FIG. 13) may be set. Regardless of the angle difference range and the angle range, the priority of another line segment that has the starting point in the area G may be highest.

Further, for example, with respect to the distance range, only two types of distance ranges, i.e., the distance range equal to or smaller than the first distance d1 and the distance range larger than the first distance d1, may be set. In a similar manner, with respect to the angle difference range, only two types of angle difference ranges, i.e., the angle difference range in which the absolute value of the angle difference is equal to or smaller than the first threshold value θ1 and the angle difference range in which the absolute value of the angle difference is larger than the first threshold value θ1, may be set. With respect to the angle range, only two types of angle ranges, i.e., the angle range equal to or larger than the third threshold value θ3 and the angle range smaller than the third threshold value θ3, may be set.

In this case, for example, with respect to the distance range, it is preferable that the higher priority is given to the distance range equal to or smaller than the first distance d1. With respect to the angle difference range, it is preferable that the higher priority is given to the angle difference range in which the absolute value of the angle difference is equal to or smaller than the first threshold value θ1. With respect to the angle range, due to the reason explained in the above-described embodiment, in the angle difference range in which the absolute value of the angle difference is equal to or smaller than the first threshold value θ1, it is preferable that the higher priority is given to the angle range equal to or larger than the third threshold value θ3. In the angle difference range in which the absolute value of the angle difference is larger than the first threshold value θ1, it is preferable that the higher priority is given to the angle range smaller than the third threshold value θ3.

Figure 14:
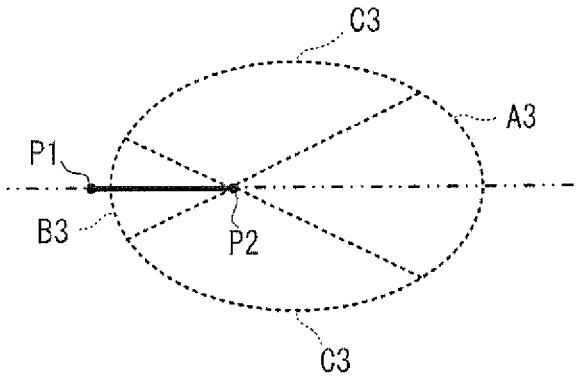
FIG. 14 is an explanatory diagram of areas A1, B1, and C1 according to another modified example.

The distance range need not necessarily be set as a same distance range (a circle whose center is the ending point of the particular line segment) in which a distance from the ending point of a particular line segment to a starting point of another line segment is. For example, as shown in FIG. 14, it is also acceptable that an ellipse is drawn whose center is a point that is separated from the ending point P2 of the line segment P1P2 in the advancing direction of the line segment P1P2, and the eclipse is divided into three types of areas A3, B3, and C3 corresponding to three types of angle ranges, in the similar manner as in the above-described embodiment. In this case, it is possible to prioritize and determine, as the next line segment, a line segment having the starting point in a position that is closer to the advancing direction of the line segment P1P2, even if the starting point is somewhat far from the ending point 2.

Figure 15:
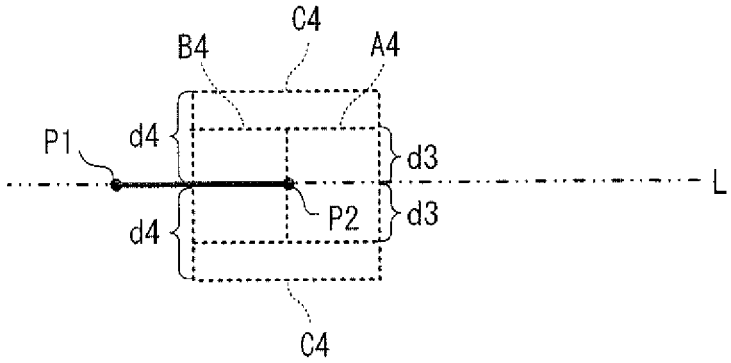
FIG. 15 is an explanatory diagram of areas A2, B2, and C2 according to yet another modified example.

Further, as shown in FIG. 15, it is also acceptable that a rectangle whose center is the ending point P2 of the line segment P1P2 is drawn and the rectangle is divided into three types of areas A4, B4, and C4. In this case, for example, an area within a distance d3 from a straight line L that passes through the line segment P1P2 in the rectangle may be formed by the area A4 located in the advancing direction of the line segment P1P2 with respect to the ending point P2, and the area B4 located on the opposite side of the area A2 with respect to the ending point P2. In an area within a distance d4 from the straight line L that passes through the line segment P1P2 in the rectangle, sections other than the areas A4 and B4 may be the areas C4. In this case, all the areas A4, B4, and C4 have a rectangular shape. Therefore, it is possible to shorten the time required to calculate which area the starting point of another line segment is in.

In the above-described embodiment, with respect to the plurality of candidate line segments LP for which the absolute value of the angle difference with the target line segment L1 is within the angle difference range 3 and which have the same priority (the plurality of line segments whose priority is one of 7 to 9 and 12 in the priority order), the candidate line segment LP for which the absolute value of the angle difference with the target line segment L1 is closest to 90 degrees is determined as the next line segment L2 (step S48 after yes at step S40, or step S48 after yes at step S46). Instead of this method, with respect to the plurality of candidate line segments LP for which the angle difference with the target line segment L1 is within the angle difference range 3 and which have the same priority, the priority may be given to the line segment for which the angle difference between the angle formed by the target line segment L1 and the line segment connecting the ending point L1T and the starting point LPS and the angle of the target line segment L1 is smallest. Alternatively, the priority may be given to the line segment for which the angle difference between the angle formed by the target line segment L1 and the line segment connecting the ending point LIT and the starting point LPS and the angle of the candidate line segment LP is smallest.

In the above-described embodiment, a priority order is not set for the areas C1 and C2, which are the area corresponding to the angle range that is smaller than the third threshold value θ3 and larger than the fourth threshold value θ4, and both of the areas C1 and C2 are treated as the same area C. Further, the range in which the angle difference is larger than θ1 and smaller than (180−θ2) and the range in which the angle difference is larger than (−180+θ2) and smaller than −θ1 are both treated as the angle difference range 3. In contrast to this, a separate priority order may be set for the areas C1 and C2 in relation to the range in which the angle difference is larger than θ1 and smaller than (180−θ2) and the range in which the angle difference is larger than (−180+θ2) and smaller than −θ1.

For example, in a case where the plurality of candidate line segments LP exist in the range in which the angle difference with the target line segment L1 is larger than θ1 and smaller than (180−θ2), the priority may be given to the candidate line segment LP whose starting point LPS is in the area C1 rather than the candidate line segment LP whose starting point LPS is in the area C2. Conversely, in a case where the plurality of candidate line segments LP exist in the range in which the angle difference with the target line segment L1 is larger than (−180+θ2) and smaller than −θ01, the priority may be given to the candidate line segment LP whose starting point LPS is in the area C2 rather than the candidate line segment LP whose starting point LPS is in the area C1.

In the line segment connection processing at step S5 of the above-described embodiment, with respect to the target line segment L1, the processing is performed taking, as the candidate line segments LP, all the line segments which are arranged at step S3 (refer to FIG. 3) in the whole area corresponding to the original image and which have not been connected to another line segment. Instead of this, the line segment connection processing at step S5 may be applied to known processing that connects a plurality of line segments for each of divided areas. Japanese Laid-Open Patent Publication No. 2010-131272 (US Patent Application Publication No. 2010/0145494) discloses processing that connects a plurality of line segments for each of divided areas, the relevant portions of which are incorporated by reference. More specifically, the line segment connection processing at step S5 may be performed taking, as the candidate line segments LP, only the line segments which have not been connected to another line segment and which are assigned to each of the divided areas. In this case, it is possible to inhibit line segments of the same color that are located separately from each other in the original image from being connected. It is thus possible to further suppress the generation of jump stitches.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a processor; and a memory configured to store computer-readable instructions, wherein the computer-readable instructions cause the processor to perform processes comprising:

arranging, based on image data of an image that is an aggregate of a plurality of pixels, a plurality of line segments in an area corresponding to the image, the plurality of line segments each having two endpoints, which are a starting point and an ending point;

sequentially connecting the arranged plurality of line segments; and creating, as embroidery data, data for stitches that correspond to the connected plurality of line segments, wherein the sequentially connecting the plurality of line segments includes, until all the plurality of line segments are connected, repeating processes comprising:

identifying, as a first line segment, a line segment having an ending point that is not connected to another line segment, from among the plurality of line segments;

calculating a distance between the ending point of the first line segment and a starting point of at least one second line segment, both of two endpoints of the at least one second line segment being not connected to another line segment, and the starting point of the at least one second line segment being an endpoint that is closer to the ending point of the first line segment, among the two endpoints of the at least one second line segment;

calculating an angle difference between a first angle and a second angle, the first angle being an angle of the first line segment with respect to a reference line, and the second angle being an angle of the at least one second line segment with respect to the reference line;

identifying a third angle, the third angle being an angle formed by the first line segment and a third line segment, the third line segment being a line segment connecting the ending point of the first line segment and the starting point of the at least one second line segment; and connecting to the ending point of the first line segment, in accordance with a priority order, a starting point of the second line segment for which a priority corresponding to a combination of a distance range to which the distance belongs, an angle difference range to which the angle difference belongs, and an angle range to which the third angle belongs is highest among the at least one second line segments, the priority order being set in advance for a plurality of combinations in which one of a plurality of distance ranges, one of a plurality of angle difference ranges, and one of a plurality of angle ranges are combined.

2. The apparatus according to claim 1, wherein the plurality of distance ranges include at least a first distance range and a second distance range, the first distance range being a distance range in which the distance is equal to or smaller than a first distance, and the second distance range being a distance range in which the distance is larger than the first distance, and the priority order is set in a descending order of priority, from a combination including the first distance range to a combination including the second distance range.

3. The apparatus according to claim 2, wherein the second distance range includes a third distance range and a fourth distance range, the third distance range being a distance range in which the distance is larger than the first distance and equal to or smaller than a second distance, and the fourth distance range being a distance range in which the distance is larger than the second distance, and the priority order is set in a descending order of priority, from a combination including the first distance range, to a combination including the third distance range, and then to a combination including the fourth distance range.

4. The apparatus according to claim 2, wherein the plurality of angle difference ranges include at least a first angle difference range and a second angle difference range, the first angle difference range being an angle difference range in which an absolute value of the angle difference is equal to or smaller than a first threshold value, and the second angle difference range being an angle difference range in which the absolute value is larger than the first threshold value, and the priority order is set in a descending order of priority, from a combination including the first angle difference range to a combination including the second angle difference range, at least in the first distance range among the plurality of distance ranges.

5. The apparatus according to claim 4, wherein the second angle difference range includes a third angle difference range and a fourth angle difference range, the third angle difference range being an angle difference range in which the absolute value is larger than the first threshold value and smaller than a second threshold value, and the fourth angle difference range being an angle difference range in which the absolute value is equal to or larger than the second threshold value, and the priority order is set in a descending order of priority, from a combination including the first angle difference range, to a combination including the fourth angle difference range, and then to a combination including the third angle difference range.

6. The apparatus according to claim 4, wherein the plurality of angle ranges include at least a first angle range and a second angle range, the first angle range being an angle range in which the third angle is equal to or larger than a third threshold value, and the second angle range being an angle range in which the third angle is smaller than the third threshold value, and the priority order is set in a descending order of priority, from a combination including the first angle range to a combination including the second angle range, at least in the first angle difference range among the plurality of angle difference ranges.

7. The apparatus according to claim 6, wherein the second angle range includes a third angle range and a fourth angle range, the third angle range being an angle range in which the third angle is smaller than the third threshold value and larger than a fourth threshold value, and the fourth angle range being an angle range in which the third angle is equal to or smaller than the fourth threshold value, and the priority order is set in a descending order of priority, from a combination including the first angle range, to a combination including the fourth angle range, and then to a combination including the third angle range, in the first angle difference range.

8. A non-transitory computer-readable medium storing computer-readable instructions that, when executed by a processor of an apparatus, instruct the processor to perform processes comprising:

arranging, based on image data of an image that is an aggregate of a plurality of pixels, a plurality of line segments in an area corresponding to the image, the plurality of line segments each having two endpoints, which are a starting point and an ending point;

sequentially connecting the arranged plurality of line segments; and creating, as embroidery data, data for stitches that correspond to the connected plurality of line segments, wherein the sequentially connecting the plurality of line segments includes, until all the plurality of line segments are connected, repeating processes comprising:

identifying, as a first line segment, a line segment having an ending point that is not connected to another line segment, from among the plurality of line segments;

calculating a distance between the ending point of the first line segment and a starting point of at least one second line segment, both of two endpoints of the at least one second line segment being not connected to another line segment, and the starting point of the at least one second line segment being an endpoint that is closer to the ending point of the first line segment, among the two endpoints of the at least one second line segment;

calculating an angle difference between a first angle and a second angle, the first angle being an angle of the first line segment with respect to a reference line, and the second angle being an angle of the at least one second line segment with respect to the reference line;

identifying a third angle, the third angle being an angle formed by the first line segment and a third line segment, the third line segment being a line segment connecting the ending point of the first line segment and the starting point of the at least one second line segment; and connecting to the ending point of the first line segment, in accordance with a priority order, a starting point of the second line segment for which a priority corresponding to a combination of a distance range to which the distance belongs, an angle difference range to which the angle difference belongs, and an angle range to which the third angle belongs is highest among the at least one second line segments, the priority order being set in advance for a plurality of combinations in which one of a plurality of distance ranges, one of a plurality of angle difference ranges, and one of a plurality of angle ranges are combined.

9. The non-transitory computer-readable medium according to claim 8, wherein the plurality of distance ranges include at least a first distance range and a second distance range, the first distance range being a distance range in which the distance is equal to or smaller than a first distance, and the second distance range being a distance range in which the distance is larger than the first distance, and the priority order is set in a descending order of priority, from a combination including the first distance range to a combination including the second distance range.

10. The non-transitory computer-readable medium according to claim 9, wherein the second distance range includes a third distance range and a fourth distance range, the third distance range being a distance range in which the distance is larger than the first distance and equal to or smaller than a second distance, and the fourth distance range being a distance range in which the distance is larger than the second distance, and the priority order is set in a descending order of priority, from a combination including the first distance range, to a combination including the third distance range, and then to a combination including the fourth distance range.

11. The non-transitory computer-readable medium according to claim 9, wherein the plurality of angle difference ranges include at least a first angle difference range and a second angle difference range, the first angle difference range being an angle difference range in which an absolute value of the angle difference is equal to or smaller than a first threshold value, and the second angle difference range being an angle difference range in which the absolute value is larger than the first threshold value, and the priority order is set in a descending order of priority, from a combination including the first angle difference range to a combination including the second angle difference range, at least in the first distance range among the plurality of distance ranges.

12. The non-transitory computer-readable medium according to claim 11, wherein the second angle difference range includes a third angle difference range and a fourth angle difference range, the third angle difference range being an angle difference range in which the absolute value is larger than the first threshold value and smaller than a second threshold value, and the fourth angle difference range being an angle difference range in which the absolute value is equal to or larger than the second threshold value, and the priority order is set in a descending order of priority, from a combination including the first angle difference range, to a combination including the fourth angle difference range, and then to a combination including the third angle difference range.

13. The non-transitory computer-readable medium according to claim 11, wherein the plurality of angle ranges include at least a first angle range and a second angle range, the first angle range being an angle range in which the third angle is equal to or larger than a third threshold value, and the second angle range being an angle range in which the third angle is smaller than the third threshold value, and the priority order is set in a descending order of priority, from a combination including the first angle range to a combination including the second angle range, at least in the first angle difference range among the plurality of angle difference ranges.

14. The non-transitory computer-readable medium according to claim 13, wherein the second angle range includes a third angle range and a fourth angle range, the third angle range being an angle range in which the third angle is smaller than the third threshold value and larger than a fourth threshold value, and the fourth angle range being an angle range in which the third angle is equal to or smaller than the fourth threshold value, and the priority order is set in a descending order of priority, from a combination including the first angle range, to a combination including the fourth angle range, and then to a combination including the third angle range, in the first angle difference range.

* * * * *